US005691497A

United States Patent [19]

Weichert et al.

[11] Patent Number: 5,691,497

[45] Date of Patent: Nov. 25, 1997

[54] SELF-LOADING GRENADE LAUNCHER

[75] Inventors: Berthold Weichert, Zimmern; Ernst Wössner, Sulz; Gerhard Gielke; Jürgen Gablowski, both of Oberndorf, all of Germany

[73] Assignee: Heckler & Koch, Oberndorf/Neckar, Germany

[21] Appl. No.: 454,142

[22] PCT Filed: Oct. 6, 1994

[86] PCT No.: PCT/EP94/03307

§ 371 Date: Sep. 5, 1995

§ 102(e) Date: Sep. 5, 1995

[87] PCT Pub. No.: WO95/10747

PCT Pub. Date: Apr. 20, 1995

[30] Foreign Application Priority Data

Oct. 8, 1993 [DE] Germany ..... 43 34 421.7

[51] Int. Cl.[6] ..... F41A 9/38

[52] U.S. Cl. ..... 89/1.4; 89/137; 89/33.2

[58] Field of Search ..... 42/105; 89/9, 1.4, 89/33.2, 33.01, 137, 180, 194, 11

[56] References Cited

U.S. PATENT DOCUMENTS

| | | | |
|---|---|---|---|
| Re. 19,159 | 5/1934 | Moore et al. | 89/33.2 |
| 636,977 | 11/1899 | Garland | 89/7 |
| 643,119 | 2/1900 | Garland | 89/7 |
| 1,737,577 | 12/1929 | Mascarucci | 89/33.2 |
| 2,093,704 | 9/1937 | Browning | 89/11 |
| 2,635,377 | 4/1953 | Higson | 42/25 |
| 2,669,160 | 2/1954 | Maillard | 89/33.2 |
| 2,875,671 | 3/1959 | Robinson | 89/33.2 |
| 2,960,917 | 11/1960 | Lizza | 89/190 |
| 2,979,992 | 4/1961 | Colby | 89/33.2 |
| 3,386,336 | 6/1968 | Roy | 89/191 |
| 3,653,132 | 4/1972 | Cashen | 89/33.2 |
| 4,539,890 | 9/1985 | Bosshard | 89/33.2 |
| 4,942,802 | 7/1990 | Stoner | 89/191.01 |

FOREIGN PATENT DOCUMENTS

| | | |
|---|---|---|
| 378976 | 7/1990 | European Pat. Off. . |
| 700629 | 11/1940 | Germany . |
| 2016281 | 10/1970 | Germany . |
| 629224 | 11/1949 | United Kingdom . |

*Primary Examiner*—Michael J. Carone
*Assistant Examiner*—Christopher K. Montgomery
*Attorney, Agent, or Firm*—Darby & Darby

[57] ABSTRACT

The invention relates to a self-loading grenade launcher with a cartridge belt feed which conveys a cartridge with pawls engaging in the cartridge belt of a cartridge belt. An inertia bolt runs forward along a path from a release position against the cartridge chamber under the force of springs and is fitted so as to slide the cartridge conveyed from the cartridge belt by the pawls into the cartridge chamber during this forward movement. A control system coupled to the inertia bolt and the slides converts the forward and recoil movement of the bolt into the transverse alternating movement of the slides. A firing device comprises a firing pin, tensioned by a percussion spring. A housing secured to the cartridge chamber extends along the bolt path and partially surrounds it, the longitudinal axis of which continues the central axis of the cartridge chamber.

55 Claims, 11 Drawing Sheets

SELF-LOADING GRENADE LAUNCHER

BACKGROUND OF THE INVENTION

1. Field of the Invention

The present invention relates to a self-loading grenade launcher with a cartridge belt feed which conveys a cartridge by means of pawls engaging in the cartridge belt preferably horizontally to the from of a cartridge belt, in which the pawls are borne by two counteracting slides movable transversely to the direction of fire and arranged in a hinged cover and project downwards. An inertia bolt runs forward along a path from a release position against the cartridge chamber under the force of one or preferably two return springs and is fitted so as to slide the cartridge conveyed from the cartridge belt by the pawls into the cartridge chamber during this forward movement and, owing to the recoil force due to the firing of the cartridge, to run back along the path and thereby retensioning the return spring or springs. A control system coupled to the inertia bolt and the slides converts the forward and recoil movement of the bolt into the transverse alternating movement of the slides. A firing device comprises a firing pin which is tensioned by a percussion spring and held by a detent in the tensioned state, whereby the detent is released and the cartridge fired before the inertia bolt has completed its forward travel but only after the cartridge has penetrated far enough into the cartridge into the cartridge chamber to hold the gas pressure resulting from firing. A housing secured to the cartridge chamber extends along the bolt path and partially surrounds it, the longitudinal axis of which continues the central axis of the cartridge chamber.

2. Description of the Related Art

A prior art grenade launcher is described in the journal "International Defense Review," Volume 22, No. 12/1989. It has a cartridge belt feed device which conveys the frontmost cartridge directly behind the cartridge chamber. An inertia bolt, which is similar in its manner of action to that of a machine gun, is moved by a closure-spring arrangement against this frontmost cartridge, pushing it into the cartridge chamber and firing it.

In the following, expressions such as "front," "rear," "side," etc. are used without further definition. They refer in all cases to the weapon in horizontal firing position, "front" indicating the muzzle and therefore the front end of the weapon in the firing direction.

In order to make the grenade launcher ready for firing, it is sufficient to move the inertia bolt, against the action of the closure-spring arrangement, into its rearmost position, in which it is held by a trigger device, and to insert the cartridge belt into the feed device.

The particular advantage of this type of grenade launcher as compared with the previously best-known self-loading grenade launcher, the US Mark 19, lies in this simple course of movements; in the case of the US Mark 19, it is necessary, after the insertion of the belt, for the bolt to be struck empty and then cocked again since the frontmost cartridge of the belt is not fed directly into the cartridge chamber upon the first striking of the bolt but rather is first brought into a transfer position from which it is conveyed by the second striking of the bolt into the cartridge chamber and fired there.

This complicated loading process leads to errors in operation as a result of which the weapon is either not ready to fire after loading or fires at the wrong time.

The prior art grenade launcher which does not have this disadvantage and is of very simple construction is, of unsatisfactory reliability in operation and function.

The object of the present invention is to provide a self-loading grenade launcher which, using the above-described advantages of the prior art grenade launcher, has better reliability in operation, better reliability in function, better operability, simpler construction and/or a less expensive construction.

The inertia bolt included in the invention like the prior art grenade launcher, fires the cartridge which is just being introduced into the cartridge chamber during the final phase of its forward movement; utilizing the kinetic energy of the forward-moving inertia bolt is so as to counteract the commencing recoil of the fired cartridge and to prevent the cartridge case from passing prematurely out of the cartridge chamber.

The moment of firing depends on the speed with which the inertia bolt moves forward. The necessary speed is obtained only if the inertia bolt reaches upon its return travel a minimum cocking position and commences its closing movement from said position.

If, in the prior art grenade launcher, the inertia bolt does not reach this minimum cocking position due to a disturbance (jammed cartridge case, incomplete or late-burning propellant charge, incomplete withdrawal of the cocking lever, for instance after a cartridge misfire), then the firing of the next cartridge takes place too soon, before it has been introduced sufficiently into the cartridge chamber. The prematurely produced gas pressure can burst the cartridge case and lead to a blocking of the loading. It can also damage the weapon.

SUMMARY OF THE INVENTION

In accordance with the invention, a barrier is provided in the event of such a disturbance, if the inertia bolt does not reach the minimum cocking position upon its return travel, prevents the forward travel of the inertia bolt. Upon the action of the barrier, the user of the weapon, in the same way as upon jamming, will, without further examining the reason for the disturbance, pull the cocking lever back in known manner and in this connection move the bolt to behind the minimum cocking position so that further disturbance-free operation is possible. Not even a full cartridge will be ejected, but the movement of the bolt will continue from where the barrier stopped it.

Thus, by the invention, the occurrence of a serious jamming or even damage to the weapon is avoided.

The minimum cocking position defines the position which the inertia bolt must assume in order not to fire the following cartridge prematurely.

The release position corresponds to the position which the inertia bolt assumes when it is released by means of the trigger device. This release position is so selected that an optimum moment of firing is assured.

In further accordance with invention the minimum cocking position is now brought as close as possible to this optimal release position.

In accordance another aspect of the invention, the barrier which prevents the striking of the bolt when it has not reached the minimum cocking position is developed as a ratchet mechanism with a number of ratchet teeth and a ratchet pawl movable relative to them. Ratchet teeth are teeth the one flank of which rises gently and the other flank rises steeply. In front of and behind the row of ratchet teeth, a space is provided for the ratchet pawl, where the pawl changes its orientation.

The ratchet teeth are so arranged that, upon the return travel of the inertia bolt, their gently rising flanks come against the ratchet pawl.

Upon the return travel of the inertia bolt, the ratchet pawl is oriented such that its free end points towards the rear. It is pressed under spring action against the ratchet teeth and pressed away by their gently rising flanks.

If the inertia bolt reverses its direction of movement during this phase, the ratchet pawl engages behind a steep flank of a ratchet tooth and blocks the movement of the inertia bolt.

At the end of the row of ratchet teeth, at a place in the return travel of the inertia bolt which corresponds to the minimum cocking position, the ratchet pawl comes free and changes its orientation so that it points away from the steeply rising flanks of the ratchet teeth and therefore cannot engage in them and thus does not prevent the movement of the inertia bolt.

The switching of the orientation of the ratchet pawl is effected by a nose which is arranged at a place which corresponds to the minimum cocking position.

In accordance another aspect of the invention the ratchet teeth are combined to form a rack-like arrangement which is arranged either on the inertia bolt or on the weapon housing, while the ratchet pawl, which is aligned by means of spring arrangement transverse to the rack, sits on the other one of these elements.

The ratchet pawl is preferably seated on the housing, since, if arranged on the inertia bolt, inertia forces acting on it could impair its function.

In the case of the aforementioned known priority grenade launcher, the control of the slides of the cartridge belt feed device is effected by grooves which are developed in the inertia bolt and in which drivers which are seated on the slides are seated.

This, in itself, very simple control has proven unsatisfactory. The reason for this may be that during very short movement paths of the inertia bolt, the slides must move over relatively long paths so that their direct guidance must take place by guide grooves which are strongly angled and thus leads to high forces and can, if, for example there is dirt, no longer be reliable. Furthermore, the amount of wear is high.

In accordance with the invention, this problem unreliability of function and resistance to wear is also solved by the invention.

In this regard, a separate cam lever is provided which extends along the path of movement of the inertia bolt and is controlled with it via a control connection which is formed of guide cam and driver. The cam lever is connected to the slides via a rod.

Thus, it is possible to produce favorable force relationships in the engagement between guide cam and driver. Furthermore, it is possible to optimize the material of the cam lever, which preferably has a guide groove, with reference, in particular, to slight wear. Furthermore, the driver, which preferably consists of a roller arranged on the inertia bolt, can be optimized, in which connection its weight contributes to the weight, which is in any event necessary, of the inertia bolt and is thus without a problem.

In accordance with yet another embodiment, the cam lever is pivotably mounted at its front end; its swinging movement is tapped off behind its center by a two-arm shift lever and transferred forwards. This arrangement, which at first sight appears cumbersome, permits a transmission of force from the cam lever to the slides without step-up ratio. The necessary tolerances between driver and control cam, which assure the dependable operation of the weapon even in the event of dirt, are thus also not increased.

In accordance with another embodiment, the lever control which connects the rod to the slides, is arranged centrally and developed symmetrically with two control levers. This arrangement provides a condition for the exchangeability of the slides and thus for the free selection of the direction of the feeding of the cartridge belt.

Another embodiment provides a further development of the control levers which are mounted in a swingable cover and provided with a disengageable coupling with which they easily pass into and out of an engagement with the rod which is seated in the housing of the weapon above the inertia bolt. In this connection, the control is effected in simple manner over only one of the two control levers, which transmits it on its part to the other control lever.

This transmission is effected, in accordance with Claim 9, by a pivoted connection between arms of the control levers. This pivoted connection is effected without the use of an intermediate element.

The engagement of each lever in the slide associated with it is effected in the same manner in each case, which not only makes a simplification in manufacture possible but constitutes another condition for the aforementioned exchangeability of the slides.

In accordance with another embodiment each slide is guided in a transverse guide which are similarly development that the two slides are exchangeable.

Upon this exchange, the slides are not only exchanged but they are also reversed in their direction, i.e., turned around, so that the transverse guides must be symmetrically designed with regard to their longitudinal axis.

This exchange of the slides makes it possible to develop the weapon with the feed from the right or the left as may be required, so that, when the weapon is installed in the entrance of a helicopter or in the hatch of a tank, the cartridge belt can be fed from the more suitable side.

A further object of the invention is to develop this feed in such a manner that it is suitable for this purpose and furthermore guides the cartridge belt and unbelts it with maximum reliability of function.

The individual cartridges are surrounded, with frictional lock, approximately in the longitudinal center of the cartridge case by a belt member which is developed in the manner of a pipe clamp and has, on the one side, a pin with a head fastened pivotally to the belt member and, on the opposite side, a protruding bow-shaped section having a slot. The slot is widened at its front end and is so dimensioned such that the head of the pin of the adjacent cartridge can pass through the widened portion of the slot but not the rest of its section, in which the neck of the pin is guided. By means of the pin-slot connection, the individual belt members are pivotally attached to each other.

In the case of the arrangement of the slides upon the forward travel of the inertia bolt, the two slides move in opposite directions, each from the outside from a starting position towards the inside, the inner pawl of the first slide engaging behind the first cartridge and conveying it up to in front of the cartridge chamber. At the same time, the second slide moves in opposite direction from its starting position and passes, with the fixed support arranged on it, to alongside the first cartridge where this support prevents the cartridge from sliding out over its position behind the cartridge case. Now, the inertia bolt has arrived behind this cartridge and pushes it into the cartridge chamber, the belt member sitting on the edge of the cartridge chamber and sliding rearward on the cartridge. Upon the firing of the cartridge, the belt member and the rear part of the cartridge case surrounded by it are outside the cartridge chamber.

Upon the return travel, the fired cartridge case pushes the inertia bolt towards the rear up to a position behind the cartridge belt feed device, where the cartridge case comes against an ordinary ejector and is ejected through a single lateral window, regardless of whether the feeding of the cartridge belt takes place from the right or the left.

At the same time, the two slides move back into their corresponding starting position, the inner pawl of the first slide swinging over the following cartridge and the support of the second slide moving outward, in order not to interfere with the extraction of the cartridge case. At the same time, the swing pawl arranged on this second slide pushes the following cartridge further into a position in which it is guided further by said inner pawl upon the next forward advance of the inertia bolt.

As can be seen, the moving up of each cartridge takes place in two successive steps, in each case upon the forward travel and return travel of the inertia bolt, so that excessive accelerations and thus excessive inertia forces are avoided.

The invention may include only one pawl, support, etc., but preferably includes several, and in particular two such elements are arranged one behind the other in the longitudinal direction of the weapon (transverse to the cartridge belt) in order to hold the cartridge, upon all its movements, always aligned in the longitudinal direction of the weapon.

Thus, the weapon is suitable also to receive without disorder a cartridge belt of the aforementioned type in which, as a result of the attachment of the belt members to each other, they are swingable with respect to each other.

Further, a fixed stop similar to the support on the outer end of the second slide is seated on the inner end of the first slide; this support has the object of preventing the cartridge belt, which is advanced with the bolt open, from sliding with its then frontmost cartridge beyond the position which it is then to assume if it is to be grasped and moved further by the inner pawl.

It has been found in tests that, upon firing, the cartridge belt carries out very vigorous, whiplike movements and experiences vibrations which can impair the introduction of the frontmost cartridge moved behind the cartridge chamber and directed to it.

To counteract this disadvantage that directly before or during the introduction of the cartridge into the cartridge chamber, the cartridge belt from which this cartridge has been already separated or removed, be moved back slightly from this cartridge; the cartridge belt can now no longer strike, as a result of its unavoidable movements, against the cartridge which is just being introduced into the cartridge chamber.

At the same time, it is also advantageous to move the support arranged on the second slide back away from the cartridge so that it is not pressed forcefully towards the side by the head of the inertia bolt and thereby subjected to unnecessarily high wear.

While the said disturbances have up to now been counteracted in that the cartridge is arranged with a large amount of lateral play in front of the cartridge chamber, in the case of the invention the cartridge is held precisely in front of the cartridge chamber until the process of introduction commences and is only then released from its lateral guides. As a result, the invention highly functionally dependable, regardless of the position and alignment of the weapon or of the accelerations acting on it. The weapon of the invention can thus also be fired during travel on a vehicle moving over the terrain without road jolts impairing the reloading function.

In accordance with the preferred embodiment shown in FIG. 15, this release of the cartridge is effected in the manner that the reversal in movement of the slides does not take place only upon the firing and therefore in the frontmost position of the inertia bolt, but already somewhat earlier, so that a further outer pawl which is arranged on the first slide and is blocked against tilting at this time pulls the cartridge belt back and the support moves away from the cartridge which has just been introduced into the cartridge chamber.

In order to block this outer pawl and therefore to prevent its tipping, the second slide is so developed that it grips over the outer pawl and thus blocks it. It is thus possible to obtain this blocking function without an additional structural part in precise association with the course of movement of the two slides.

As already mentioned above, the frontmost cartridge of the cartridge belt is in an intermediate position when the inertia bolt is in its rearmost position (release position). In this intermediate position, the frontmost cartridge is gripped behind and supported by the swing pawl of the second slide.

Upon the insertion of the cartridge belt, however, the cover bearing this swing pawl is swung up.

Furthermore, in the ready-to-fire position, the frontmost cartridge lies continuously against this swing pawl so that it must withstand all inertia forces exerted by the cartridge belt.

In order to fix the exact position of the cartridge belt upon its insertion and with the cover open, and in order to take up the inertia forces of the cartridge belt, an upwardly urged blocking lever, which acts like a pawl, is arranged below the cartridge belt fed, against the protruding end of which lever pointing to the longitudinal center of the weapon, the outer side of the frontmost cartridge rests in said intermediate position.

If the belt is conveyed further, then the blocking lever moves away downward evading the following cartridge, without hindering it, and then passes, when it is in the intermediate position, again upward in order to again act as support. In this way, not only is a stop for the precise insertion of the cartridge belt created, but, furthermore, the wearing-out or even breaking-off of the swing pawl or structural parts connected with it is prevented.

The cartridge used for the grenade launcher of the invention is a rim cartridge, and therefore a cartridge with a radially protruding rim. Furthermore, this cartridge bears a belt member. If such a cartridge lies on a flat surface, then the longitudinal axis of the cartridge is inclined to this surface. The movement of such a cartridge precisely parallel to its longitudinal axis is thus problematical.

In view of this problem, the invention is directed at permitting an exact and thus particularly disturbance-free introduction of the cartridge into the cartridge chamber.

In this case, below the cartridge chamber there is developed a guide table on which the advanced cartridge belt rests and can be fed smoothly and without disturbance onto a cartridge rest.

When the process of removal from the belt takes place and the frontmost cartridge is introduced into the cartridge chamber, then the cartridge rest moves away downward in such a manner that the cartridge, gripped on its bottom by the head of the inertia bolt, can align itself to it, and thus be dependably introduced into the cartridge chamber.

The tip of the cartridge thus always remains at the height of the center of the cartridge chamber; only the rear part dips so far downward upon the evasion of the cartridge support that the axis of the cartridge is directed fully on the axis of the core.

In order to make certain that the cartridge rest does not yield at the wrong time, it is controlled by the movement of the inertia bolt and is released by the latter only when, shortly before or when it removes the frontmost cartridge from the belt and in this connection introduces it into the cartridge chamber.

The cartridge rest bears the relatively heavy cartridge at least for a short period of time, in which connection blows acting on the weapon can multiply the load on the cartridge rest. Spring loading alone is thus probably not sufficient in order to provide assurance that the cartridge rest only yields when it is controlled by the inertia bolt.

In order to remedy this problem a lock is provided which holds the cartridge rest fast in its normal position. The lock is released by the inertia bolt so that the release of the lock is always adapted in reliable manner to the lowering of the cartridge rest, which is also controlled by the inertia bolt.

The cartridge rest can be developed as a plate, but it is developed as an arrangement of at least one transverse finger the mass of which is relatively slight, so that its rapid evasion and swinging back does not result in any disturbance in the movement of the bolt and, in particular, does not result in high wear.

It is a general rule that weapons of all kinds should not be fired empty, namely without cartridge or buffer cartridge in the cartridge chamber.

On the other hand, it is necessary, upon the development, frequently to exert firing, loading operations, etc. on the weapons.

In order to avoid the damage to the grenade launcher of the invention which it could experience by the empty firing of the inertia bolt, a buffer spring arrangement which intercepts and brakes the inertia bolt during the final phase of its forward movement is provided.

This buffer spring arrangement is so developed that it does not enter into action upon the normal shooting process, since the inertia bolt can then move forward at most up to the bottom of the cartridge which protrudes a distance out of the cartridge chamber, but not up to the buffer spring arrangement.

Preferably two spring guide rods which extend parallel to the longitudinal axis of the weapon are provided for the closing springs, said rods passing through the inertia bolt in each case in a longitudinal hole. At the front end of each of these spring guide rods there is arranged a buffer spring which rests against the front end of the housing and preferably is seated in part, in a bore hole so that sufficient space for the reception thereof is created.

The arrangement of two buffer springs supplies, as does the arrangement of two closure springs, a redundance of parts which, in the event of the breaking of a spring, makes further operation of the weapon possible, although perhaps with disturbances.

The buffer springs can possibly be installed only for training purposes, and be removed before use of the weapon.

In a traditional self-loading weapon, the bolt is, as a rule, guided in grooves and ridges which are developed within the housing. These slide surfaces extended into the ejector opening and the opening for the feeding of the cartridge belt and can therefore easily collect dirt, which can lead to malfunctioning.

Furthermore, the outer walls of the housing which form these slide surfaces must be sufficiently stiff and thus correspondingly heavy.

Furthermore, it is difficult to produce the slide surfaces arranged with large distance apart opposite each other with sufficient precision.

In order to improve the reliability in function of the grenade launcher of the invention with, at the same time, reduced cost of construction, the inertia bolt is not guided on its outer surface but is passed through by a longitudinal channel with which it is seated displaceably on a longitudinal guide arranged fixed in position in the housing.

The relatively small dimensions of the longitudinal guide and of the longitudinal channel permit simple manufacture with sufficient dimensional precision. The housing sidewalls, if they are not to perform other functions, need merely be developed as covering and can be correspondingly light or be made of correspondingly less stable material, for instance plastic.

Most important, however, is the fact this guide arrangement within the housing is at a far distance from openings therein through which dirt can pass into the inside of the housing.

With a suitable arrangement of the longitudinal guide, its ends can be arranged in regions of the housing in which no parts essential for the functioning are arranged; dirt which is pushed by the movable inertia bolt to the ends of the longitudinal guide can collect there without impairing the reliability of the function of the weapon. Thus, the operation of the weapon, even in dust and mud, is possible over a long period of time without cleaning of the weapon being absolutely necessary.

A particularly cost-favorable and, at the same time, dirt-protecting and thus functionally dependable development resides in the use of a round rod as longitudinal guide which is guided in a clearance hole within the inertia bolt.

The round rod can have annular grooves to receive lubricant, slide rings, or dirt.

A simple supporting of the bolt for example, by engagement of the driver in the guide groove of the cam lever, is entirely sufficient to prevent the inertia bolt from turning around the round rod.

The housing of the self-loading weapon of this type affords great problems even if it is not to serve as longitudinal guide for the inertia bolt: Development as a forging of steel or light metal which is subsequently machined is difficult and furthermore very expensive. A welded construction from blanks or stamped and bent parts is, to be sure, easier and cheaper, but it is still difficult to produce free of warping and in correct dimensions. Furthermore, a welded housing has fine, inaccessible grooves which can form the starting points for corrosion. Welded housings of light metal are particularly expensive.

A housing which is as light as possible but with accurate dimensions, preferably of light metal, with as few joints as possible, is desirable.

This requirement is satisfied by the grenade launcher of the invention. The main section of the housing is formed of a section of a hollow-profile material which can possibly be subsequently machined (for instance, ejection window). The hollow-profile material is closed on its front side by a block in which the barrel is seated and which possibly bears the longitudinal guide as well as spring guide rods.

The rear of the hollow-profile material section can be closed by the trigger device.

The hollow-profile material can preferably be an extruded hollow profile, preferably of light metal, for instance duraluminum. The hollow-profile material can on the inside have longitudinal ribs, etc., which can serve for the guiding of the inertia bolt insofar as it is not guided by the longitudinal guide rod described above.

The hollow-profile material can have longitudinal ribs, longitudinal grooves, etc., on its outside which can serve to receive a gun-carriage mount, sights, infrared illumination, or the like.

The hollow-profile material is preferably, a closed box profile or hollow profile which receives the inertia bolt and is extended towards the top by an open box profile or hollow profile which receives the cam lever and is covered by a removable cover. The lengthwise partition wall between the closed and open hollow profiles has a lengthwise extending milled slot which is passed through by the driver arranged on the inertia bolt. The swing pins for the cam lever, shift lever, etc. are also seated in this partition wall.

The particular advantage of this arrangement is that the sensitive control is arranged in a manner substantially protected separately against dirt and also powder gases and nevertheless is readily accessible.

The outer and/or inner surfaces of the housing formed in this manner are preferably surface-treated in order to achieve a camouflage coloring, resistance to corrosion by, for example, salt water, and improved abrasion resistance, and other desirable surface properties.

Hard anodizing of the inner and outer surfaces of the light-metal housing has proven particularly suitable.

As already mentioned, the cartridge belt which is fed jerkily in the case of continuous firing, tends to carry out sudden whiplike movements, which can lead to disturbances in function.

In order to mitigate these movement and assure a smooth entrance of the cartridge belt into the weapon, a belt guidance platform which supports the cartridge belt from below is provided and a covering which guides the cartridge belt from above both of which can be applied detachably to the housing of the weapon.

While the belt guidance platform and the covering adjoin the cartridge belt from the bottom and top respectively at the cartridge belt inlet opening of the weapon housing, this opening is limited at its front and rear ends by a freely rotatable cartridge belt guide roller. Both cartridge belt guide rollers have such a diameter that a hooking of the cartridges to the rollers is impossible. Preferably, both cartridge belt guide rollers are of circular cylindrical shape and have the same diameter.

As already frequently mentioned above, the device of the invention for the guiding and unbelting of the cartridge belt can be reversed for feeding from the right or from the left as desired, and preferably without the use of any exchange parts. Accordingly, the weapon housing has two entrance openings for the cartridge belt which lie opposite each other.

These entrance openings are preferably arranged on both sides of the housing but, in the case of special use of the grenade launcher, for example, in land, sea, or air vehicles, can also be arranged on the top and bottom of the housing.

In order to avoid unnecessary dirt, the entrance opening which is not being used can be closed by a wall or covering which is preferably developed as an attachable sheet-metal plate, but can also be developed as a plastic plug which can be inserted.

The above-mentioned belt guide platform and covering are developed symmetrically with respect to their center line, which extends in each case transverse to the longitudinal axis of the weapon, so that they can be arranged in front of each of the entrance openings.

In order still further to improve the disturbance-free guidance of the cartridge belt contained in an ammunition box, complementary holding means are developed on this ammunition box and on the weapon housing, which means comprise a mount closer to the or each entrance opening on the housing.

The covering can be a structural element which is permanently attached to the weapon housing but it preferably forms a part of the ammunition box so that the covering, after it has been placed on the weapon housing, forms a continuous reliable guide for the cartridge belt from the ammunition box into the weapon.

The covering is preferably arranged on the cover of the ammunition box or forms a part with it.

The cartridge belt again can only be inserted into the weapon when the cover bearing the slides has been opened and the inertia bolt is in its rearmost position, namely its position of release.

In this position of release, the inertia bolt is acted on, to be sure, by the closure spring arrangement and is held merely by the trigger device.

If the belt is inserted, or if it is attempted, for instance, to eliminate a jam, then the hand of the user is present in the path of movement of the inertia bolt. If the bolt is now unintentionally released or if it becomes released due, for instance, to a road jolt of the vehicle on which the weapon is mounted, then an injury to the hand of the user, which may be serious, is to be expected. This is all the more serious if the user requires the injured hand at that very time primarily in order to operate the weapon.

In order to avoid this disadvantage, a bolt lock which is coupled to the cover and activated when the cover is opened is provided in the weapon of the invention. This bolt lock either holds the inertia bolt in its position of release and prevents its firing even if it has been released by mistake or as the result of a disturbance, or intercepts the forward traveling bolt before it can reach the region of the cartridge feed device and injure a hand which is present there.

This bolt lock can be positively coupled with the cover or with its interlock but it is preferably provided with a sensor which determines whether the cover is in its closed position or not.

This sensor can control a release device, but it is preferably a feeler finger which is urged into its blocking position by a spring, namely into a position in which it makes the bolt lock active. The feeler finger is directly connected for transmission of movement with a lock lever which can engage into the inertia bolt or into its path of movement and hold it fast or stop it.

Insofar as the inertia bolt is provided with a driver guided in the cam lever, said lock lever is advantageously movable into the path of movement of the driver. The driver namely forms a particularly resistant structural part protruding from the inertia bolt and is not damaged even if it travels forcefully against the lock lever.

In order, now, to permit also easy construction of the lock lever, it engages into a recess in the cam lever. This cam lever is of very stable development as a heavily loaded structural part and is supported on a strong mount fastened to the housing.

If the driver of the inertia bolt comes against the lock lever, then the latter introduces all forces taken up by into the sufficiently stable cam lever on which it rests in the recess.

The engagement projection of the lock lever is in this connection only slightly loaded, since it transmits all forces acting on it; thus, there is no danger of the engagement projection or the lock lever breaking off, but rather assurance is had that the blocking always remains active.

The position of the engagement projection and of the recess in the cam lever is so selected that the inertia bolt is stopped only shortly before reaching the cartridge feed device.

This arrangement has the advantage that the barrier, the feeler finger of which extends into the region of the cover, is developed as short as possible. Furthermore, by the noticeable striking of the inertia bolt up to the lock lever, it is clearly recognizable by the user that the inertia bolt, by mistake or due to a disturbance, is no longer in the release position, and before closing the cover he can bring it again into its release position, so that the undisturbed operation of the weapon can be continued, insofar as no damage is present.

There are a large number of safety devices which will prevent the unintended firing of a cartridge.

In a weapon of the type in accordance with the invention, such a safety is even more important than in other weapons, since the firing of a cartridge is to take place only when the inertia bolt is at a given position shortly in front of the end or its path of movement and has a given speed there.

Another object of the invention is to provide an effective safety.

This object is achieved by an embodiment in which the firing pin is seated in a firing-pin case which, in its turn, is seated in longitudinally displaceable manner in the inertia bolt and is movable into a rear position in which it prevent the firing pin from emerging out of the impact bottom of the inertia bolt in order to fire a cartridge.

While the dimensions, material, and weight of the firing pin are structurally established within narrow limits, such limitations do not apply to the firing-pin case, so that it can be readily provided with safety devices or coupled to them.

This firing-pin case is so developed that there is no possibility of the firing pin firing a cartridge when the firing-pin case is in its rear position.

The firing-pin case is connected in particularly advantageous manner by means of a control lever with a cam which is fastened to the housing, so that the firing-pin case is moved, for all practical purposes, into its frontmost position only in the region of that position of the inertia bolt, in which the firing of cartridge is to take place. Thus, any improper firing is out of the question.

The firing pin is connected via an intermediate part with a firing-pin spring for the driving, is engaged or locked in its cocked position, and is released as a function of the position of the inertia bolt.

If the firing pin is not driven by the firing-pin spring due to a break or the like of a functional part such as, for instance, the firing-pin spring, then it can, upon the striking of the inertia bolt move in uncontrolled fashion and lead to further damage.

In the absence of the action of the firing-pin spring, the intermediate part engages directly or indirectly into the control of the firing-pin case in such a manner that it continues to remain in its rear position.

The aforementioned grenade launcher of the prior art has, on both sides of the path of movement of the inertia bolt, a lengthwise slit in each of the housing sidewalls which is passed through by a handle which extends transverse to the longitudinal axis of the weapon and is fastened to the inertia bolt.

Upon firing, the two handles carry out a longitudinal movement; if this movement is prevented, then this can lead to a disturbance in function.

Furthermore, dirt can enter the housing through the longitudinal slits passed through by the handles.

However, the loading process is particularly cumbersome, because the user must bend over the weapon and, with one or both hands, grip the handle or each handle and pull it strongly rearward. Since, in this case, the force of the very strong closing spring arrangement must be overcome, a considerable expenditure of force is necessary. Furthermore, it is impossible, upon this activity, to retain the alignment of the weapon on a mount, since the weapon, on its part, is pulled strongly rearward via the handle or handles.

Thus, it is, for instance, purposeless to set the uncocked weapon on a target, since the setting is lost upon the cocking.

However, it is frequently particularly important, for instance to direct the weapon in daylight onto a section of the terrain, for instance a dip in the terrain or a street where one expects the presence of the enemy at night. In this case, it is not possible for safety reasons to keep the weapon continuously cocked.

Furthermore, the user is forced, for example, when a jam occurs, to bend over the weapon and thus place himself into a dangerous position.

These disadvantages limit the usefulness of the known grenade launcher to a substantial extent.

In another embodiment, these disadvantages are eliminated. Here, the handle for the cocking of the inertia bolt is developed as a pull grip on the rear of the housing, which grip is connected, via a rod, a pull member to the inertia bolt, so that, upon the pulling-out of the pull grip, the inertia bolt is carried along rearward into the release position.

Then the pull grip is pushed completely again into the housing so that the inertia bolt can move back and forth without being prevented by the pull grip, its rod, or its pull member.

This development has no handle which moves back and forth upon the shooting. The rod or pull member is moved in its longitudinal direction through a housing opening in the rear wall of the housing, and not in its transverse direction, so that it can always completely cover the housing opening passed through by them and thus exclude the penetration of dirt.

However, the fact that the user who has gripped the handle or pull grip with the one hand in order to cock the inertia bolt can support himself with the other hand on the rear of the housing, preferably on the handle arranged there, is of particular advantage. Thus, all forces are active between the two hands of the user; a component of force which could disturb the setting of the weapon can be avoided after a slight amount of practice.

However, in particular, the user upon cocking the inertia bolt can remain covered behind the weapon and need not bend over it.

Preferably, a disengageable barrier is provided which holds the handle or the pull grip detachably in the inserted position in order to prevent the handle loosening as a result of vibration or the like, and disturbing the movement of the inertia bolt via the rod or the pull grip.

A particularly suitable force-transmitting connection between handle and inertia bolt without additional structural parts also provided. In this embodiment, as also in the prior art grenade launcher, there are two closing springs each of which is guided on a spring guide rod. The closing springs are developed as compression springs; they are seated between the inertia bolt and the rear end of the housing and each of them surrounds a spring guide rod.

These spring guide rods, however, are not seated, fixed in position in the housing, as in the prior art grenade launcher, but are displaceable in their longitudinal direction. On their rear, they bear the handle or pull grip, and, on their front, they bear a driver arrangement by which they grip behind the inertia bolt from the front and carry it along rearward upon their rearward movement.

In their frontmost position, in which they are held as a result of the detachable barrier which holds the handle, their front ends extend preferably into recesses or holes in the front end of the housing and are thus held stably against lateral deflection upon the firing.

The driver arrangement can be formed by a protruding annular collar, but it is preferably developed as a buffer spring the front end of which rests on a support firmly connected to the spring guide rod, for instance a spring ring.

The two spring guide rods lie horizontally alongside each other in the housing; the handle is thus formed as a horizontal grip which extends transversely to the longitudinal axis of the weapon. This is very favorable from an ergonomic standpoint.

Furthermore, the weapon preferably has on its rear, in customary fashion, two vertical grips arranged alongside of each other, with each of which a thumb-actuated trigger plate is associated. Both trigger plates can be combined into a single thumb plate.

Upon the cocking of the inertia bolt, the user grips the horizontal handle with that hand which he prefers to use and with his other hand grips the vertical handle opposite it. Now, the weapon is so to be pulled up with subjectively little expenditure of force so that no force or scarcely any force is applied to the mount of the weapon.

The above-mentioned barrier for the detachable holding of the horizontal handle has an integrated release lever which is positively actuated upon the gripping of the handle and places the lock into action upon release of the handle. Thus, a necessary separate operation (loosening of the lock) is integrated in another operation (gripping or release of the handle), so that the particularly simple operation is assured.

Another problem of the known weapon resides in the danger of unintended firing due to a disturbance of the weapon.

The inertia bolt is detachably held by the trigger device, in which connection, by means of a hook-shaped swing lever which is swingable by means of the trigger thumb plate, it engages behind a transverse sear on the end of the inertia bolt which is released upon the actuation of the trigger-thumb plate.

The inertia of the inertia bolt and the force of the closing spring arrangement are large. If inertia forces which act in longitudinal direction and support the force of the closure springs, for example due to the vehicle bearing the weapon striking hard against a bump in the road, are also present, then the force acting on the hook section of the swing lever becomes very great.

On the other hand, this swing lever (or better, a pair of similar swing levers lying alongside each other) must not be too heavy so that it is not, on its part, unintentionally released by inertia forces against the force of the restoring spring acting on it. This restoring spring, on its part, must not be too hard, so that a targeted withdrawal is possible. Due to the structural constrictions indicated, the danger of a break in the force-absorbing parts of the trigger device in the case of a weapon of the aforementioned type is greater than, for instance, in the case of a self-loading pistol. If this danger is reduced by a strong development of the swing lever, then at the same time the danger of unintended firing by inertia forces which actuate the trigger device is increased at the same time.

While the last-mentioned danger can be reduced by suitable safeties which can hold the swing lever or an element particularly high inertia in the trigger device, the danger of the breaking-off of the release lever cannot be counteracted by any safety, which merely holds the trigger device fast.

Proceeding from this problem, the invention solves these difficulties providing a further additional safety device which holds the inertia bolt fast independently of the trigger device.

If the trigger device fails, then the additional safety device holds the inertia bolt fast in, or close to, its release position.

If the above-mentioned spring lever should be broken and the trigger device thus becomes inactive, then the weapon could still be fired if necessary, the additional safety device being used as trigger. The weapon is thus not entirely useless despite a considerable disturbance.

In order to permit this possibility of emergency operation, the additional safety device is contained, also in the trigger device, namely by a catch hook of its own which preferably engages behind the trigger sear on the inertia bolt like the swing lever connected with the trigger.

It would be possible to associate the catch hook with an actuating and locking arrangement of its own. It is, however, preferred that it be coupled with the safety device which is, present, so that a separate operating handle and thus a separate operation can be dispensed with.

The catch hook is arranged in positive manner slightly in front of the actual release position, so that upon the release of the trigger device, if the additional safety device is active, the inertia bolt moves a short distance forward, drops into the catch hook, and can no longer be held by the trigger device proper.

If the weapon is now without safety, the shot takes place. In order to prevent this, a measure is taken which permits the release of the inertia bolt which is held by the catch hook only when it has been previously moved back into the release position.

This measure can consist of a deeply recessed catch hook which is held fast by the trigger sear on the inertia bolt into which it engages in such a manner that is cannot enter the non-safety position.

In this case, to be sure, the above-mentioned possibility of the firing of the weapon by means of the additional safety device is not present.

The object of the invention will be further explained by way of example with reference to the accompanying diagrammatic drawing, in which a single preferred embodiment of the grenade launcher of the invention has been shown. In this embodiment, all the above-indicated features of the claims have been combined.

However, it is expressly pointed out that the corresponding groups of features can be realized also independently of other groups of features in the case of a weapon.

Other objects and features of the present invention will become apparent from the following detailed description considered in conjunction with the accompanying drawings. It is to be understood, however, that the drawings are designed solely for purposes of illustration and not as definition of the limits of the invention, for which reference should be made to the appended claims.

DESCRIPTION OF THE PREFERRED EMBODIMENTS

Figure 1:
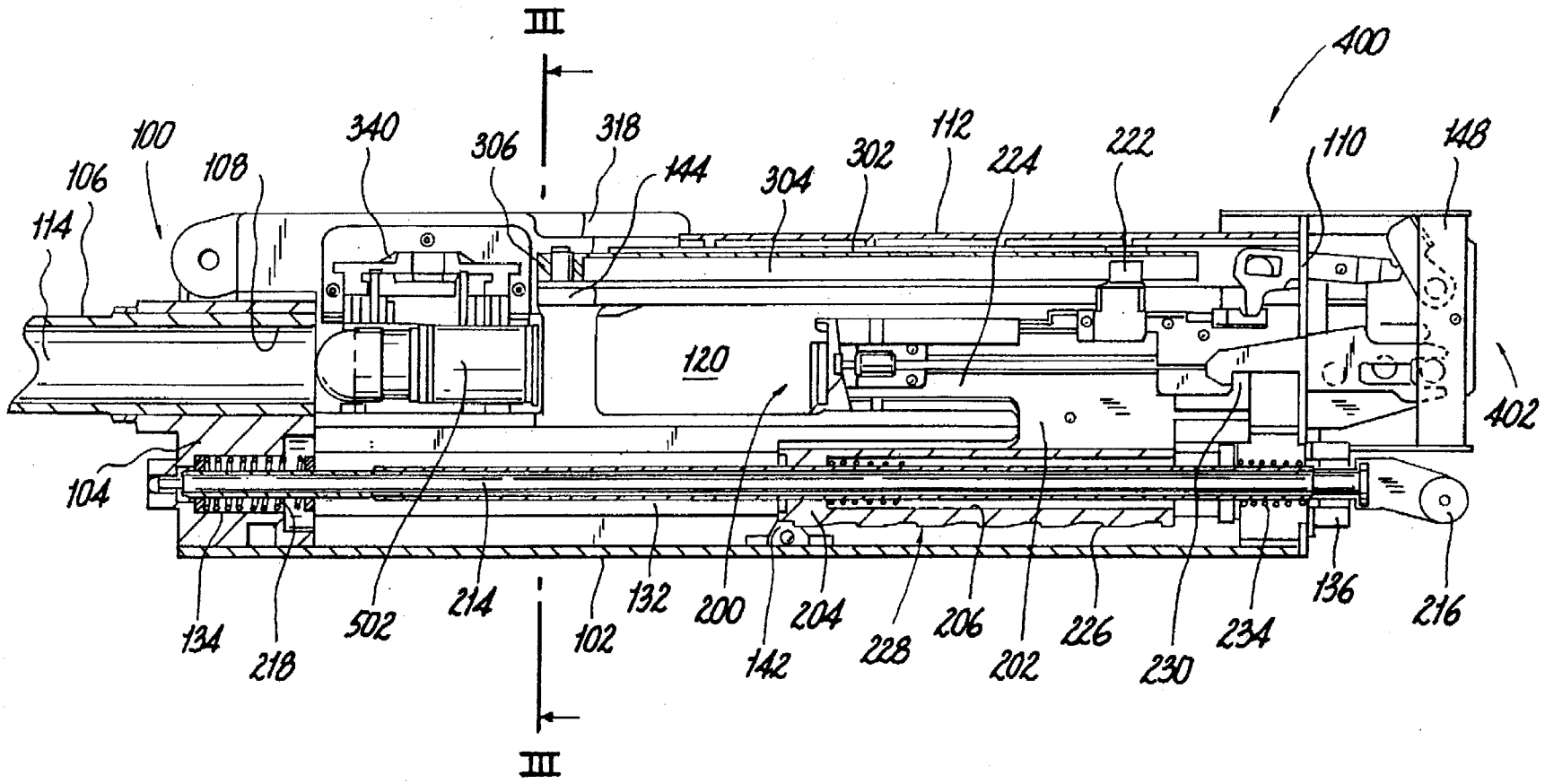
FIG. 1 is a longitudinal view of an embodiment of a grenade launcher of the invention, with the housing cover and feeder cover removed.

In the figures, the same reference numerals have been used in all cases for the same structural parts or elements.

Figure 2:
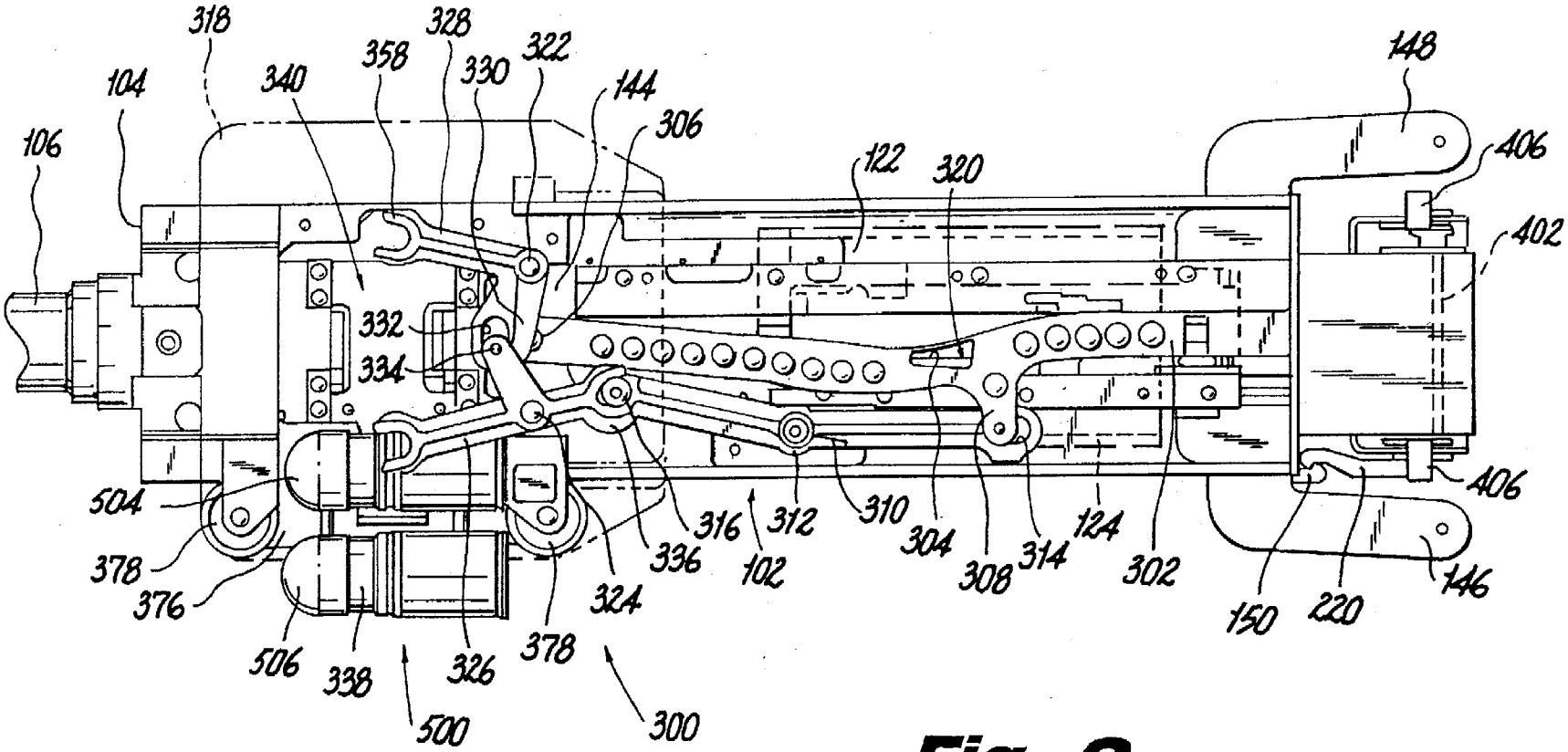
FIG. 2 is a top view of the grenade launcher shown in FIG. 1.

The grenade launcher shown in the overall views of FIGS. 1 and 2 consists essentially of a housing group 100, a bolt group with spring and handle device 200, a feeder group with control 300, and a trigger device group 400. The cartridge belt introduced into the grenade launcher is designated 500; it is known per se and as such does not form a part of the weapon.

The Cartridge Belt 500

Figure 3:
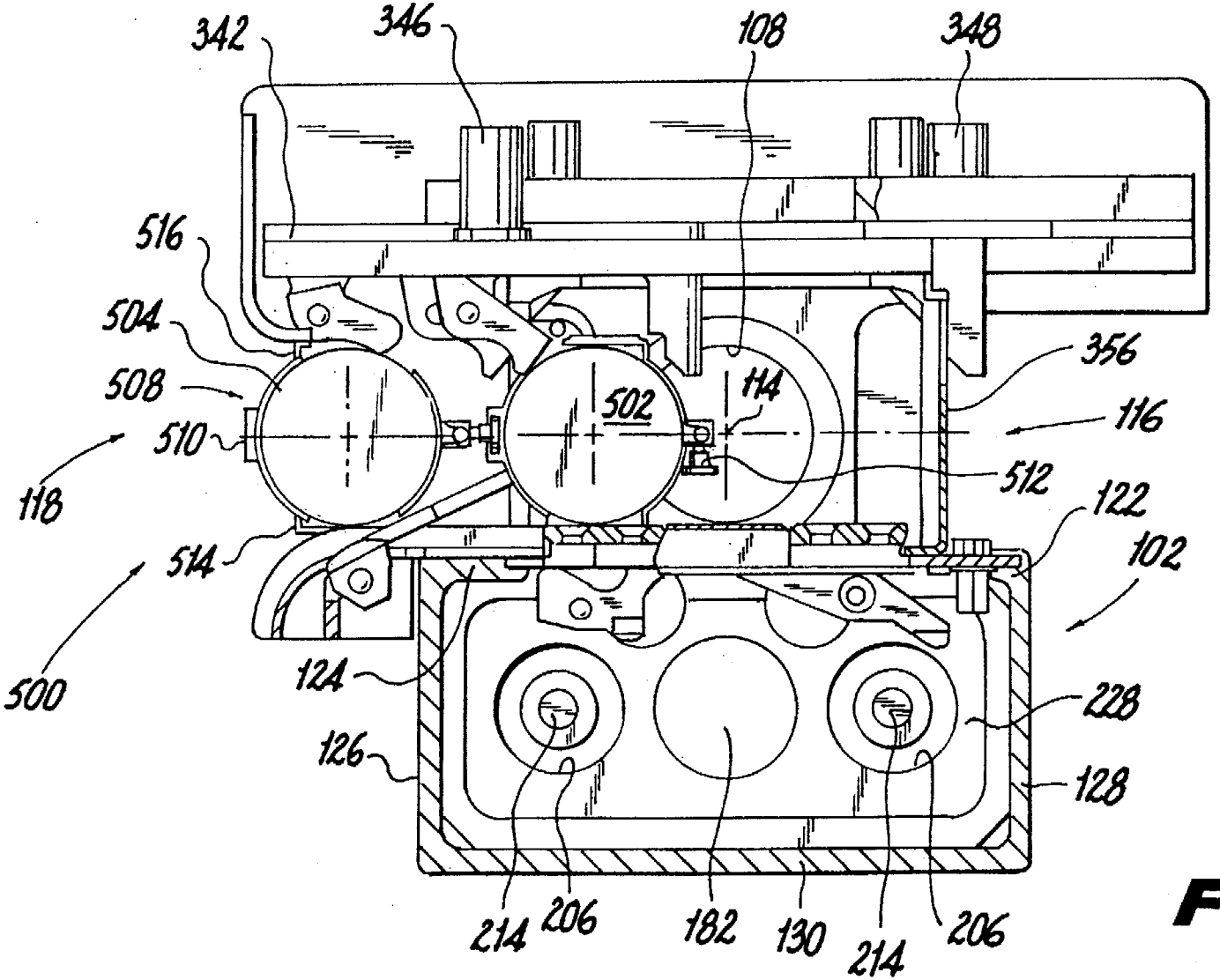
FIG. 3 is a diagrammatic section through the grenade launcher along the line III—III of FIG. 2.

For a full understanding of the weapon, however, the known cartridge belt will first of all be discussed, reference being had to FIGS. 1 and 3. In the other figures of the drawing, the reference numerals relating to the cartridge belt have been omitted in order not to confuse the drawing.

The cartridge belt contains a front cartridge 502, a first following cartridge 504 and other cartridges 506 (only one shown in FIG. 2).

Each of the cartridges 502, 504, and 506 has a missile and a cartridge case, which at its rear end has a flange-like protruding rim, and receives the primer and the propelling charge.

Each cartridge case bears a belt member 508 which surrounds it like a pipe clamp and is formed of a sheet-metal band. The belt members 508 are omitted in FIG. 2.

The belt member has on the upper and lower sides of the cartridge 502, 504, in each case a wide, flattened projection 516 and 514 respectively, on the one side (to the left in FIG. 3) a narrow flattened projection 510 which has a slot with widened end, and on the other side a projection having a pivot pin 512 which is arranged pivotally on it and has a thickened free end.

When the belt is assembled the pivot pin 512 is seated in the slot in the projection 510 of the adjacent belt member 508 and engages behind it with its thickened end.

If adjacent cartridges are shifted against each other, then the thickened end of the pivot pin 512 comes in front of the widened end of the slot which receives it so that the two adjacent cartridges 502, 504 can be moved apart. In this way, the removal from the belt takes place; the belt member 508 remains also on the unbelted cartridge.

The belt member 508 is seated, in the case of the un-shot cartridge, approximately on the front half of the cartridge case and tightly surrounds it.

If the cartridge is introduced into a cartridge chamber 108, then the belt member sits on the rear end of the cartridge chamber 108 and is pushed rearward up to against the rim of the cartridge. The cartridge can thus be introduced into the cartridge chamber 108 only to such an extent that the cartridge rim is separated from the rear end of the cartridge chamber 108 by a distance which corresponds to the axial length of the belt member 508.

The cartridge case is so constructed that it withstands the gas pressure upon the firing, although it is not completely introduced into the cartridge chamber 108.

The preferred embodiment of the grenade launcher of the invention will now be described:

The Housing Group 100

The main part of the housing group is formed by an extruded hollow-profile bar 102, referred to in the following as the "housing", which has essentially a cross section with two parallel side arms which are connected in one piece at their lower end and approximately at their center by, in each case, a straight cross arm which is attached at a right angle.

The housing 102 thus has a left housing wall 126, a right housing wall 128, and a housing bottom 130

The longitudinal center line of the housing is designated 114.

The housing 102 is formed by the cutting to length and subsequent machining of an extruded hollow-profile bar, in which connection, as a result of the machining, a front transversely extending milling is formed which serves for the introduction of the cartridge belt 500, having a right entrance opening 116 and a left entrance opening 118, and furthermore, an ejection opening 120 developed in the right housing wall through which fired cartridge cases, dummy cartridges, or cartridge duds are ejected from the housing, and a lengthwise milling in the upper transverse bar so that by the latter a right housing rib 122 and a left housing rib 124, shown in FIGS. 2 and 3, are formed thereby; on each of the facing edges of the two housing ribs 122, 124 there is arranged a steel strip with a cam, namely the cam 138 for the firing pin case 416 on the right-hand edge and the cam 140 for the control of the striking of the firing pin 414 on the left edge.

The place where the recess in the upper transverse rib limited by the two housing ribs 122, 124 is not necessary, said rib remains, for instance at the bridge 144.

The housing 102 is hard-anodized in order to obtain a suitable coloring (camouflage color) and surface quality (resistance to rubbing and slide behavior).

In the front end of the housing 102, a steel block 104 is firmly arranged, it bearing the barrel 106, centered on the longitudinal center line 114, having the cartridge chamber 108.

The steel block 104 has, below and on both sides of the barrel 106, in each case a rearwardly open blind receiving hole 134 which is, in each case, passed through by a spring guide rod 214 and receives a buffer spring 218 seated and supported on said bar.

The buffer spring extends towards the rear up into the enlarged mouth of the receiving hole 134. This mouth is so dimensioned that it can receive, in each case, a projection 204 of the bolt carrier 228 of the inertia bolt 202 when the latter moves all the way forward (upon striking without cartridge).

In the bottom of the blind hole 134, a stepped supporting and receiving passage hole debouches in which the spring guide rod 214 developed with a guide ring bead and an end pin is contained substantially without play. In this connection, the free, front end of the end pin is rounded so that the spring guide rod, when it is moved forward into the receiving hole 134, can align itself.

In the center, between the two receiving holes, the housing 102 is passed through lengthwise by a round rod 132 (FIG. 1, indicated in FIG. 3) which is fastened in the steel block 104 and guides the inertia bolt 202 upon its movement.

On the rear of the housing 102, the latter is closed by an end covering 110 in which two guides 136 for the spring guide rods 214 are seated and in which the round rod 132 is supported.

The end covering bears a part of the trigger device group 400 and can be removed towards the rear together with the latter and the bolt group 200.

The top of the housing 102 is covered by a removable housing cover 112 which extends from the end covering 110 up to approximately the bridge 144.

Approximately in the center of the length of the housing 102, a ratchet pawl 142 is arranged for swinging around a transverse pin on the inner side of the housing body 130 and is so acted on by a spring system (not shown) that it tends to assume a substantially vertical position.

On the housing 102 further parts, not shown in detail here, are also fastened, for instance an ejector on the inner side of the left housing wall 126, a mounting for a sight on the outer side of the left housing wall 26, in each case a mount for an ammunition box outside on the left or right housing wall 126, 128 in the region of the left and right entrance openings 118, 116, a mount for the application of a gun mount on the outside on the left and right housing walls 126, 128 and/or on the housing bottom 130, etc.

Furthermore, at the rear end, on the outside on the left and right housing walls 126, 128, there are arranged in each case an upper and lower holding bracket extending rearward and towards the outside; the end of the holding brackets which lie one above the other are each connected by generally vertical left and right handles 146, 148.

The gripping of one or both handles 146, 148 permits the aiming and firing of the grenade launcher in customary manner.

Finally, on the rear of the left housing wall 126, on the bottom and outside there is a rearward extending extension which, on its rear end, has an inward-pointing detent projection 150, but as a whole is so arranged that it does not prevent the removal and insertion of the bolt group 200.

The Bolt Group 200

The bolt group 200 has an inertia bolt 202 which is formed of a bolt head 224 which is coaxial to the longitudinal center line 114 and a bolt carrier 228 parallel thereto, which lie one above the other and are connected together at their rear.

The bolt head 224 has on its front side an impact bottom 208 which is limited on the right side by an ordinary spring-actuated, forward protruding extractor 210.

Opposite this, an extractor (not shown) is also arranged on the left side in order, in case of vibration of the weapon, to assure a disturbance-free extraction of the cartridge case through the region taken up by the cartridge belt 500 up to in front of the ejection opening 120; this left-hand extractor is opened upon the return travel of the bolt by a stop which is fixed on the housing and it frees the edge of the extracted cartridge case shortly before the latter comes against the ejector which also fixed on the housing.

The bolt head 224 has, coaxial to its longitudinal center line 144, an axial bore hole 212 (see FIG. 7) which is developed as a blind hole open at the rear, the bottom of which is passed through in customary manner by a passage channel for the tip of the firing pin 414.

This axial hole 212 receives the above-mentioned firing-pin case 416, the firing pin 414, and its firing spring (not shown).

The bolt carrier 228 has three holes: a fitted hole (not shown) which is intended to slide substantially without play on the round rod 132, and two rearwardly open closure-spring-receiving blind holes 206 which are coaxial to in each case one of the receiving holes 134.

The bottom of these closure-spring-receiving blind holes 206 is passed through in each case by a smaller hole through which a spring guide rod 214 extends in each case.

Over the rear section of each spring guide rod 214 there is placed a closure spring 234 which is developed as a coil compression spring.

Each of these closure springs rests at the front against the bottom of the corresponding closure-spring receiving hole 206 and at the rear against the spring rod guide 136.

The above-mentioned projections 204 are developed on the front side of the bolt carrier 228.

As stated when describing the housing group 100, the spring guide rods 214 extend in the fire-ready condition of the grenade launcher, forward up into the corresponding developments of a corresponding receiving hole 134 in the steel block 104, in which then a buffer spring 218 pushed over the spring guide rod 214 is also received.

This buffer spring 218 can rest either directly against the bottom of the receiving hole 134 or against a radial projection of the spring guide rod 214.

Upon the pulling back of the spring guide rod 214, the buffer spring 218 is carried along eight by the guide ring bead formed in front of said spring on the spring guide rod 214 or by its support on the spring guide rod 214 itself.

The two spring guide rods 214 extend through the spring rod guides 136 to the rear and are firmly connected to each other there by a cocking grip 216 which extends below the lower ends of the right and left handles 148, 146, transversely and horizontally respectively.

In order to cock the bolt 202, the cocking grip 216 is pulled out sufficiently far horizontally to the rear from the housing 102 and pushed in forward direction then until it comes against the stop. In this connection, the one hand of the user grips the handle 146 or 148 corresponding to said hand in order to support himself, while the other hand actuates the cocking grip 216. Thus, cocking of the weapon is possible without the user having to bend over the weapon and without it being necessary to exert on the weapon forces which might impair a possible previously effected adjustment on a target.

In the region of the left end of the cocking grip 216, there is arranged on it a release lever 120 which is swingable about a vertical axis and pressed by spring force towards the outside, it being so arranged that with the cocking grip 216 pushed fully forward it engages in blocking fashion behind the detent projection 150 of the housing 102. In this connection, the facing edges of detent projection 150 and/or release lever 220 are so beveled that they engage in each other when they are moved against each other.

The release lever is provided with a lengthening (not shown) which is so arranged on the cocking lever 216 that, upon the gripping of the latter, it can also be easily gripped so that the releasable barrier formed by the detent projection 150 and the release lever 220 is opened and the cocking process is not prevented.

If the cocking grip, on the other hand, is pushed all the way forward and released, then this releasable barrier 150, 220 enters into engagement and prevents any undesired release of the cocking grip 216.

The bolt head 224 furthermore bears at the rear on its top a centrally arranged cam lever driver 22 which is preferably formed as a hardened roller which is turnable around a vertical axis.

On the rear of the inertia bolt 202 there is furthermore arranged a trigger sear 230 which is developed as a transverse upwardly extending strip the surface of which lies just below the longitudinal center line 114 and the front side of which forms a substantially vertically descending transverse surface.

The trigger sear 230 is so developed that it is gripped from above by a nose on the front end of a trigger lever 404 which is swingably supported in the trigger device 402 around a horizontal axis. If the nose of the trigger lever 404 is swung upward, the trigger sear 230 and thus the inertia bolt 202 are released so that the bolt can move rapidly forward under the action of the closure springs 234.

Figure 10:
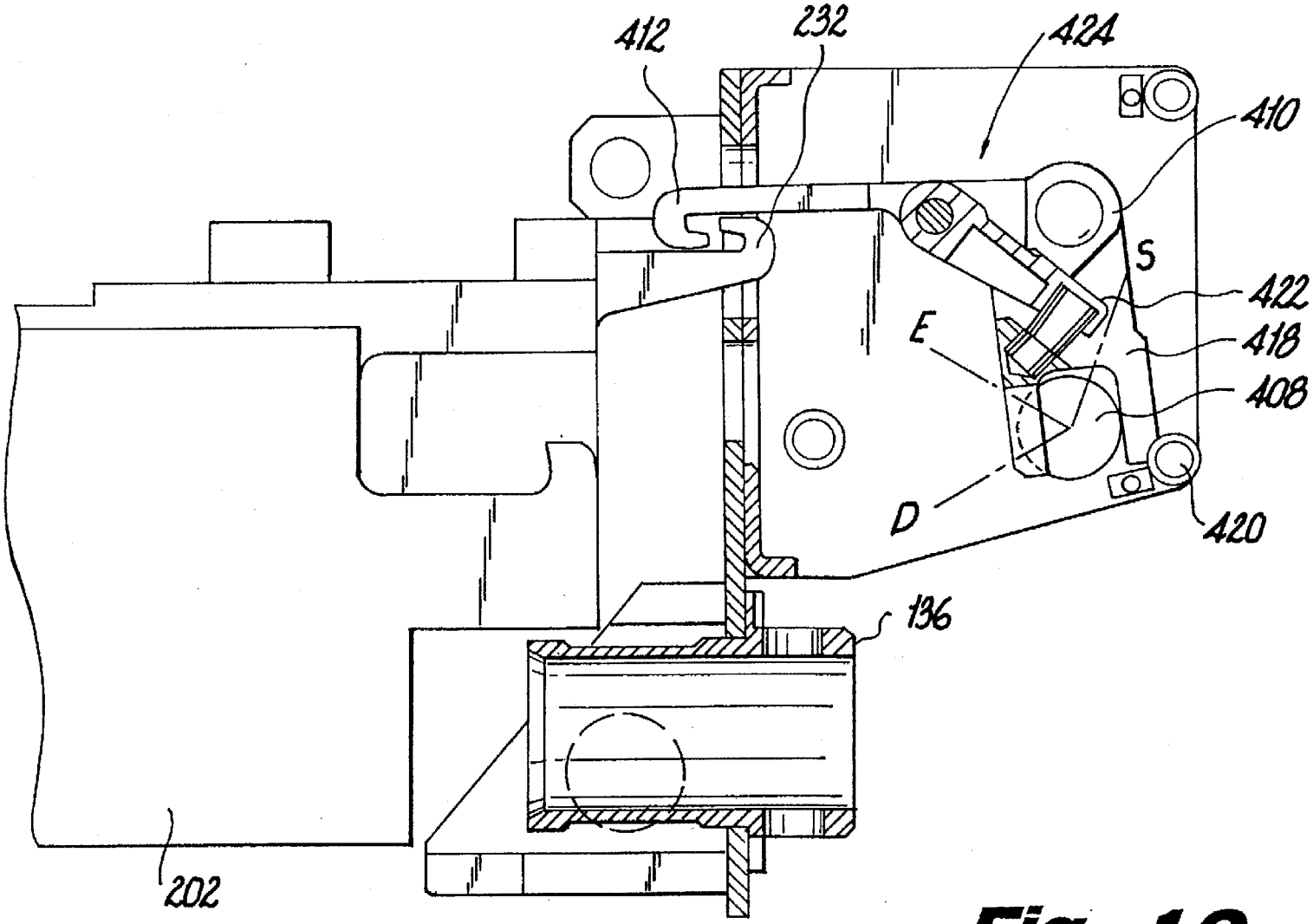
FIG. 10 is a diagrammatic partial sectional showing of the bolt catch device.

Above the trigger sear 230 there is a hook-like catch projection 232 which is open towards the front and can be gripped from above; it is shown in FIG. 10 and will be explained further below in connection with the trigger device group 44.

Figure 1A:
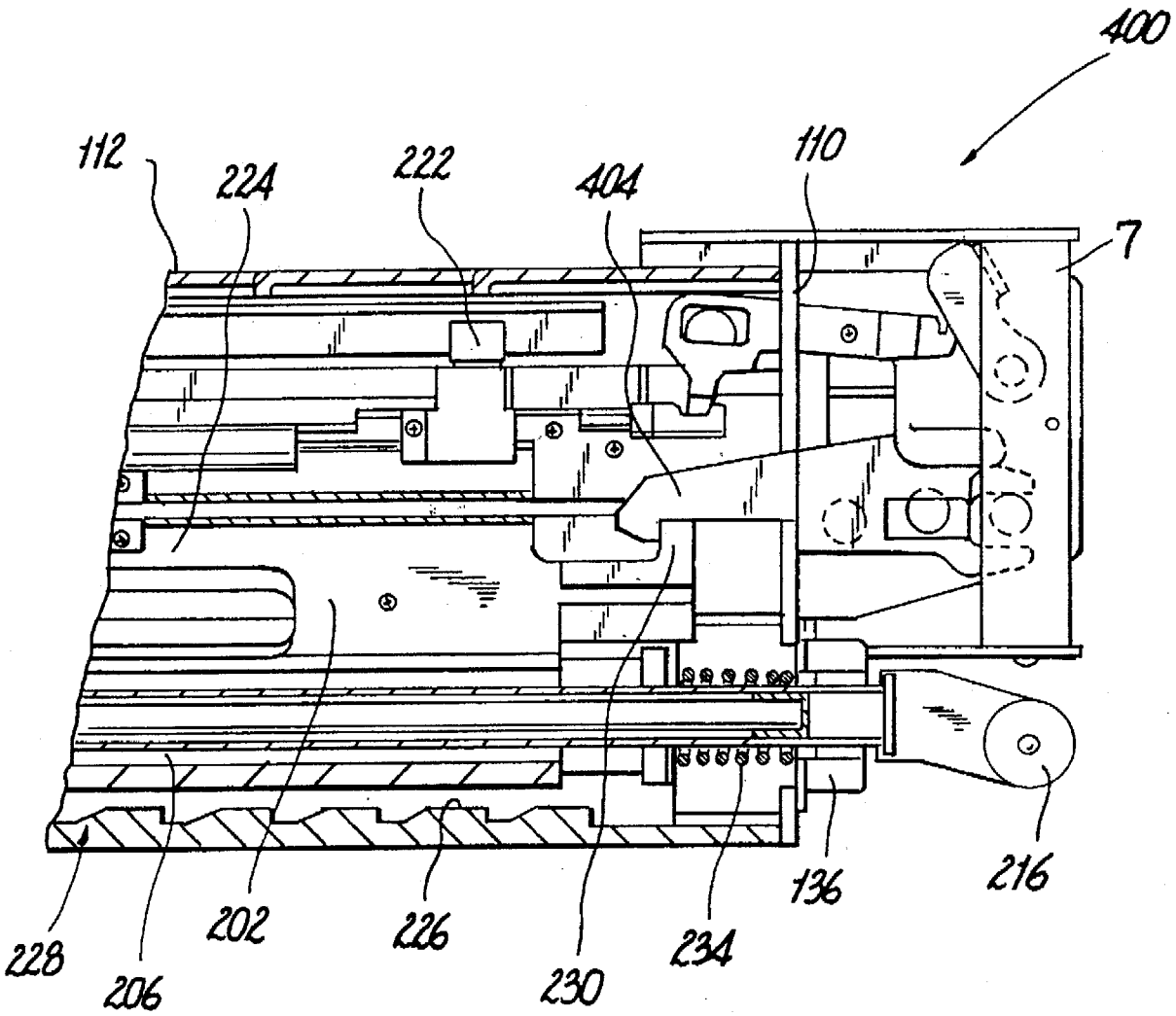
FIG. 1*a* is an enlarged partial view of FIG. 1.

On the bottom of the bolt carrier 228, as is also shown on FIG. 1*a* there is arranged a row of ratchet teeth 226 lying one behind the other in longitudinal direction, the front tooth flanks of which extend vertically, the tooth tips of which are horizontally flattened, and the rear tooth flanks of which are inclined at a very shallow angle of, for instance, 10° with respect to the horizontal.

The space between the rear tooth flank of a front ratchet tooth 226 and the front tooth flank of a following ratchet tooth 226 is flattened horizontally.

The vertical distance between the ratchet teeth 226 and the ratchet pawl 142 arranged swingably on the housing 102 is such that the ratchet pawl 142 can erect itself under the ratchet teeth 226 only up to such an oblique position that it is able, when it is tipped towards the rear, to apply itself in blocking fashion against one of the front tooth flanks while, when it is tipped to the front, it allows the ratchet teeth 226 to slide unimpeded over it.

The length of the rack-like row of ratchet teeth 226 and thus of the bolt carrier 228 is so dimensioned that this row has traveled completely forward or backward over the ratchet pawl 142 when the inertia bolt 202 is in its frontmost or rearmost position.

In each of these positions, the ratchet pawl 142 can thus erect itself completely under spring action so that, upon the return travel of the inertia bolt 202, it is tilted towards the rear while upon the forward travel thereof it is tilted towards the front.

In the position shown in FIG. 1 and FIG. 1*a* the inertia bolt 202 is in its release position, in which it is held fast in its position by the engagement of the trigger lever 404 in the trigger sear 230. This release position is slightly in front of the rearmost end of the return travel, where it permits the ratchet pawl to erect itself completely. Now, in the release position, the front end of the rack-like row of ratchet teeth 226 acts from the rear against the ratchet pawl 142 and tilts it forward.

If the inertia bolt 202 is now released, it travels unimpeded over the ratchet pawl 142 until it comes into its frontmost position. Here the ratchet pawl 142 moves up again behind the rack-like row and is tilted towards the rear upon the return travel.

If now, the return travel is interrupted for any reason, for instance because a cartridge has been fired with insufficient recoil or the user has been interfered with upon the cocking of the inertia bolt 202, so that its rearward motion is interrupted already in front of the release position, the inertia bolt 202 can then no longer move forward rapidly. This is only possible when the return movement has been completed by means of the cocking grip 216.

Thus, an undesired firing is prevented which could possibly take place, for instance, upon the release of the cocking grip 216, since in the position of the inertia bolt 202 reached at that time (in front of the release position), the trigger lever 404 can still not engage in the trigger sear 230 and hold the inertia bolt 202 fast.

The stopping of the inertia bolt 202 in a position in front of the release position is advisable in the case of many weapons, for instance most machine pistols or machine guns, but in the case of the weapon described it is furthermore of fundamental importance, since in this weapon the firing of the cartridge 502 does not take place only when it has been fully introduced into the cartridge chamber 108, but rather already a short, precisely determined period of time prior to this when cartridge 502 and inertia bolt 202 are in full movement, in which case, in known manner, the kinetic energy then applied serves in order to take up a part of the recoil which is produced by the shooting of cartridge 502.

Since, however, as mentioned at the start, the cartridge 502 cannot be introduced fully into the cartridge chamber 108, but protrudes by a considerable amount (axial length of the belt member 508) our of the chamber 108 when it is fired, the exact position of the inertia bolt 202 and its narrowly tolerated speed in each case at the moment of firing become highly critical values. The ratchet mechanism 142, 226 described sees to it that the speed of the inertia bolt 202 upon the firing of the cartridge 502 is definitely within the permissible tolerance.

Thus, the barrier is developed as a ratchet barrier (142, 226) with a series of obliquely toothed ratchet teeth (226) which are disposed along the inertia bolt (202) or the housing (102), and at least one ratchet pawl (142) which can be brought into engagement with the ratchet teeth (226) and, upon forward travel of the inertia bolt (202), enters into a blocking engagement with the ratchet teeth (226) but can be disconnected, upon travel past a nose which is arranged at a place which corresponds to the minimum cocking position. Further, the ratchet pawl (142) is positively movable by a spring into a position in which it extends transverse to the path of movement of the inertia bolt (202). Since the ratchet teeth (226) are seated on a rack-like arrangement extending above the inertia bolt (202) or housing (102) bearing them, the start and end of this arrangement, upon backward or forward travel, moves beyond the ratchet pawl (142) and thus in each case it is possible for the ratchet pawl to erect erect itself.

The Feeder Group 300

The feeder group 300 consists of the actual feeder device, its control, and the belt entrance; the control, on its part, consists of the housing-side control elements and the control elements arranged in a feeder cover 318.

The housing-side control elements consist of a cam lever 302 and a double-armed shift lever 310, both of which are mounted for swinging around a vertical axis in the housing 102.

The cam lever 302 is formed of a downwardly open U-shaped bar the upward facing bottom of which is perforated in order to lighten its weight and to form dirt-collection spaces. The U-shaped bar is, as a whole, slightly S-shaped as seen from above. Its downward-directed cavity forms a curved cam 304 lying in a horizontal plane, in which the cam lever driver 222 which sits centrally, on top and behind on the bolt head 224 can slide practically free of play.

The cam lever 302 is swingably mounted on its front side (top side of its S-shape) on a mounting pin 306 which is arranged firmly, centrally and vertically in the bridge 144 and protrudes upward from it.

Upon the linear forward and rearward movement of the inertia bolt 202 and thus of the cam lever driver 222, the latter moves along the cam 304 and thus causes the cam lever 302 to effect a swinging movement the course of which is controlled by the curvature of the cam 304.

Shortly behind the center of its length the cam lever 302 has a cam lever recess 320 which is open toward the right (toward the right housing rib 122), which recess extends into the bottom and the right side wall of the cam lever, but in no way impairs the action of the cam 304.

Into this cam lever recess 320 there extends a lock lever (not shown) which is coupled with a spring-actuated feeler finger (not shown) which is held down by the closed feeder cover 318.

Normally, this lock lever is out of engagement with the cam lever recess 320 and thus does not exert any action.

However, if the feeder cover 318 is opened, for instance to insert a cartridge belt 500 or to eliminate a jam, then the feeler finger can move out under spring action and carry the lock lever along with it, which then engages into the cam lever recess 320 and rests on the edge thereof.

If the user now by mistake permits the inertia bolt 202 to strike, then this is taken up by the running of the cam lever driver 222 against the lock lever, so that the inertia bolt 202 cannot reach and injure the hand of the aiming or loading user which may be located just at this time in the region directly behind the cartridge chamber 108. The vibration upon this impact is so great that it is noted by the user who then need merely pull the cocking grip 216 back. Due to the strongly beveled rear edges of the ratchet teeth 226, the inertia bolt 202 can be moved backward, although the ratchet pawl 142 is tilted forward.

Directly behind the cam lever recess 320, the cam lever 302 has a side arm 308 which protrudes substantially at a right angle to the left and the free end of which bears a downward directed pin which fits and engages into a slot 312 in the rear end of the double-armed shift lever 310.

This shift lever 310 is at the height of the cam lever 302 between the latter and the left housing wall 126 and extends approximately in the lengthwise direction of the housing 102.

The double-armed shift lever 310 is formed of two arms of equal length which form with each other a very obtuse angle of about 165°.

In its center, the double-armed shift lever 310 is arranged swingably on a vertical mounting pin 322 which is fastened firmly, and protruding vertically upward, on the left housing rib 124.

On the front, free end of the double-armed shift lever 310 there is arranged a shift lever pin 316 which protrudes upward from the top of the shift lever 310. This shift lever pin 316 is located slightly behind the bridge 144.

The housing cover 112 covers all housing-side control elements (cam lever 312, shift lever 310) from above in dust-tight manner; only the front end of the shift lever 312 together with the shift lever pin 316 protrudes forward beyond the front edge of the housing cover 112.

In front of the housing cover 112, a feeder cover 318 is arranged on the housing 102 and fastened swingably around a horizontal transverse axis by means of a hinge arrangement which is developed on the top of the steel block 104. The feeder cover 318 is shown in FIG. 1, its contour merely indicated in dashed line in FIG. 2, and shown diagrammatically in FIG. 3. In all three figures the feeder cover 318 is in its closed condition in which it is held by a releasable barrier.

The feeder cover 318 is wider by practically an entire cartridge diameter than the housing; it extends rearward to beyond the front edge of the housing cover 112 and thus screen off in the manner of a roof the corresponding entrance opening 116, 118 in the housing 102 from downward falling dirt (mud, sand, earth).

Furthermore, the feeder cover 318 covers the slot between the bridge 144 and the front edge of the housing cover 112.

The feeder cover 318 is developed as a downwardly open shallow container. In the part of the feeder cover 318 which lies in the closed position thereof above the bridge 144, there are fastened two vertical mounting pins 322, 324, the axes of which lie at equal distance from the longitudinal center line 114 in a common plane perpendicular thereto.

On the left mounting pin 324 there swingably mounted a substantially straight first control lever 326 which, in the position of the inertia bolt 202 shown in FIG. 2 (release position), extends forward and outward from the mounting pin 324 by an angle of about 15°.

The first control lever 326 is extended rearward and terminates in a rear receiving jaw 336 which is in releasable and force-transmitting engagement with the shift lever pin 316.

Also at its front end, this first control lever 326 has a receiving jaw 338 which is in releasable force-transmitting engagement with a first slide pin 346.

The first control lever 326 also has a control-lever arm 330 which protrudes substantially horizontally and at a right angle from the region of the left mounting pin 324, which arm extends to approximately over the longitudinal center line 114 and, on its free end, bears an engagement pin 334 which extends vertically downward.

On the right mounting pin 322, there is swingably mounted a substantially straight second control lever 328 which, in the position of the inertia bolt 202 shown in FIG. 2 (release position), extends forward and outward by an angle of about 15° from the mounting pin 324, namely symmetrically to the first control lever 326.

At its front end, this second control lever 328 has a receiving jaw 338 which is in releasable force-transmitting engagement with a second slide pin 348.

The second control lever 328 is a lever, bent at a right angle, the vertex of the angle lying within the region of the right mounting pin 322.

The angularly bent part of the second control lever 328 forms a control-lever arm 330 which extends to approximately above the longitudinal center line 114 and at its free end has a slot 332 which receives the engagement pin 334 with a slide fit and extends substantially transversely to the path of movement thereof upon the swinging of the first control lever 326.

The engagement pin 334 and the slot 332 thus form a substantially play-free positive coupling which sees to it that the second control lever 328 follows exactly in opposite direction the movement of the first control lever 326 upon the swinging movement thereof: If, for instance, the rear part of the cam lever 302 swings in closure direction in the top view of FIG. 2, then the two front receiving jaws 338 of the two control levers 326, 328 move towards each other with the same speed.

The two slide pins 346, 348 (FIG. 3) are preferably developed as rotatably mounted rollers in order to reduce the friction upon the engagement in the receiving jaws 338.

The feeder cover 318, however, not only assumes a part of the control, as described, but also the essential part of the actual feeder device.

The latter has a first slide 342 and a second slide 344 (FIG. 4), both of which, displaceable horizontally and transversely to the longitudinal center line 114, are received in a slide guide 340 which is contained in the feeder cover 318.

The first slide 342 bears, protruding upward, the first slide pin 346, the second slide 344 (FIG. 4) also bears the second slide pin 348. The two slide pins and their movement paths are both on a common plane perpendicular to the longitudinal center line 114.

This slide guide 340 is so developed in its cross section transverse to the direction of the slide movements, and can be taken apart to such an extent that the two slides 342, 344 can be taken out and inserted again in direction opposite their original direction of movement.

As a result of the symmetrical drive by the two control levers 326, 328, the two slides 342, 344 also operate in reverse alignment, but then convey the cartridge belt 500 in opposite direction into the weapon, and therefore not through the left entrance opening 118 as shown in FIG. 2 but through the right entrance opening 116.

The entrance opening 116 or 118 not used at the time is, as can be noted from FIG. 3, closed by a sheet-metal plate 350 or other covering in order to prevent dirt from entering into the weapon.

The further elements of the feeder device are described with reference to FIGS. 4 to 8 and, for the sake of clarity, are provided with reference numerals only in those figures.

The first slide 342 has, protruding downwards on its right end, a fixed stop 356 and, on its left end, an outer pawl 352 and, approximately in the center, an inner pawl 354.

The second slide 344 has, protruding downward, at its right end a fixed support 360 and at its left end a swing pawl 358.

Each of the pawls 352, 354, and 358 are developed as downward-protruding fingers which, on their upper end, can be swung against spring force upward and towards the entrance opening 116 which is closed by the sheet-metal plate 350, in each case around an axis which is parallel to the longitudinal center line 114.

The cartridge belt 500 enters the weapon through the other entrance opening 118.

The lower edges of the pawls 352, 354, and 358 are so developed that, when they protrude downward and are moved in direction of introduction of the cartridge belt 500, they engage behind the frontmost and possibly the second cartridge 502, 504 respectively and convey them.

If the pawls 352, 354, and 358, however, are moved, opposite the direction of introduction, against a cartridge 504, they are then swung away by the cartridge which is encountered so that they can pass below them.

Figure 4:
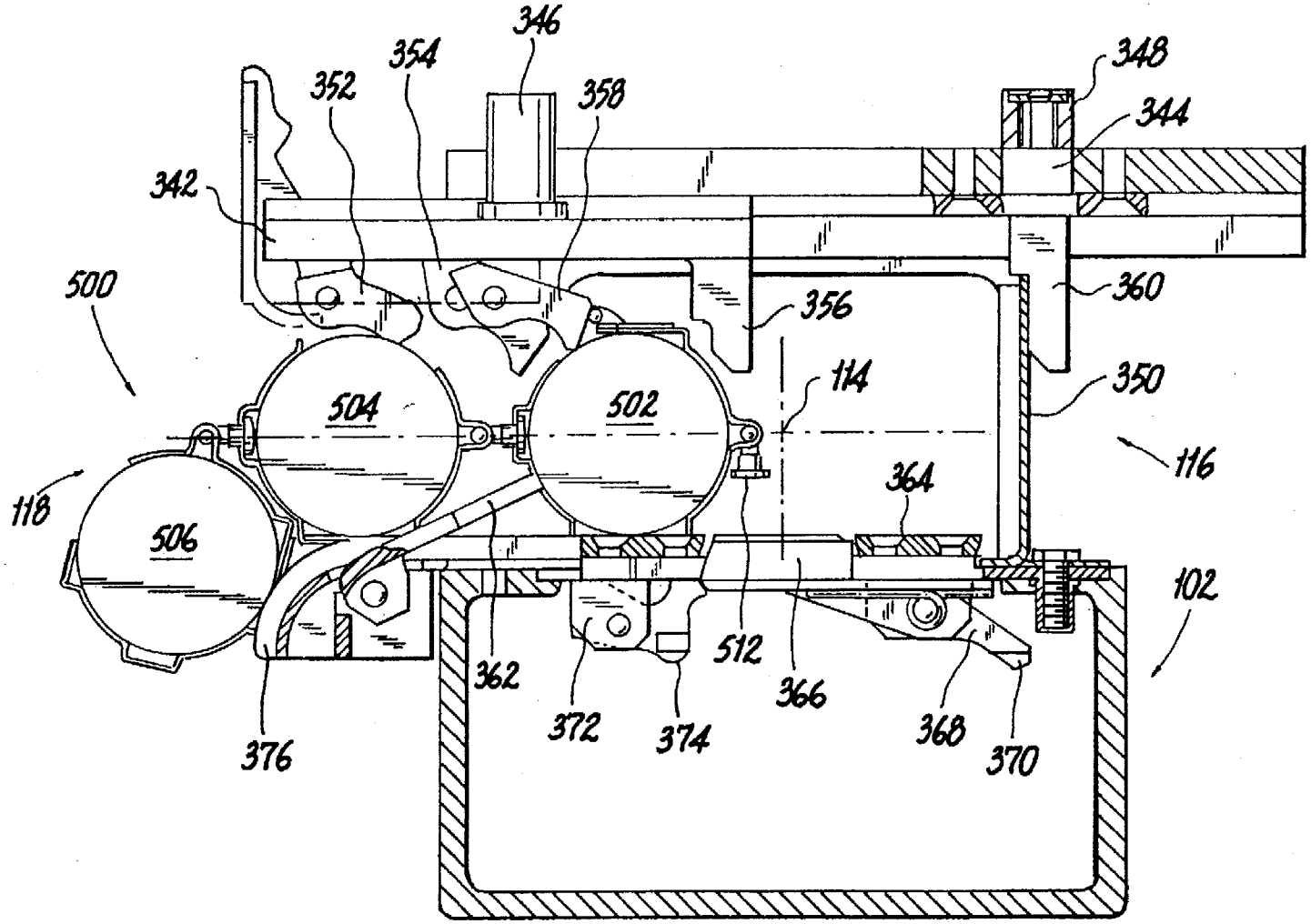
FIG. 4 is a section similar to FIG. 3 in which the feeder position after insertion of the cartridge belt is shown, the inertia bolt being in its release position (rearmost position)

When the two slides 342, 344 are present between the two relative positions of FIGS. 3 and 4, only the outer pawl 352 then comes into blocking engagement with the second slide 344 so that it then cannot be swung away but moves in the direction opposite the direction of introduction of the cartridge belt 500 against the second cartridge 504 and pushes the latter (and thus the entire cartridge belt 500) back slightly without swinging away.

On the housing 102, below the entrance opening 118 used, the outer end of a blocking lever 362 pointing into said opening is swingably mounted around an axis parallel to the longitudinal center line 114; it is lifted by spring action up into the position shown in FIGS. 4 and 5 and can be pressed down by the cartridge 504 traveling over it into the position shown in FIGS. 6 to 8.

The manner of operation of the elements borne by the two slides 344, 346 and of the blocking lever 362 will be briefly described below with reference to the sequence of movements shown in FIGS. 4 to 8

FIG. 4 shows the position of the cartridge belt 500 and of the two slides 342 344, when the weapon, after a shot has been fired, is cocked and ready to shoot, and the inertia bolt 202 is accordingly in its release position.

The blocking lever 362 is moved up and supports the first cartridge 502 from the outside, the swing pawl 358 is about to move away over this cartridge 502 and already grips behind it but has not yet reached its fully vertical position. The outer pawl 352 has just been swung away upward by the second cartridge 504 and the inner pawl 354 is in its fully vertical position.

If the cartridge belt 500, on the other hand, is first to be inserted, then the feeder cover 318 is swung open, all pawls 352, 354, and 358 being then in fully vertical position, the frontmost cartridge 502 of the cartridge belt 500 is placed behind the vertical, free end of the blocking lever 362 pointing towards the longitudinal center line 114 and is held against it by slight pulling on the cartridge belt 500, and the feeder cover 318 is again closed.

The position of all parts is then the same as in FIG. 4, with the exception that the swing pawl 358 is in fully vertical position and engages behind the first cartridge 502.

Figure 5:
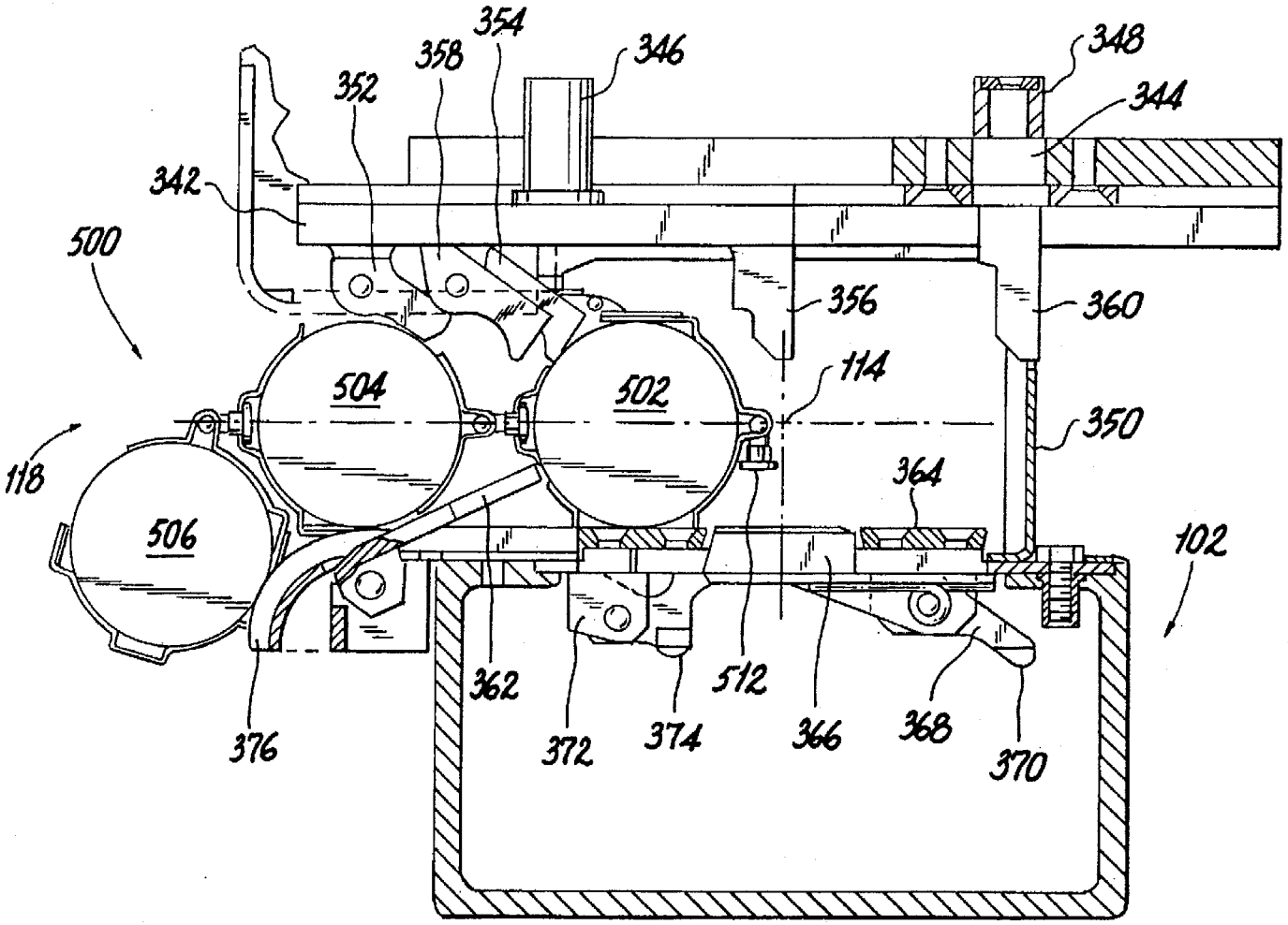
FIG. 5 is a sectional view, such as shown in FIG. 4, after the inertia bolt has started its forward movement.
Figure 6:
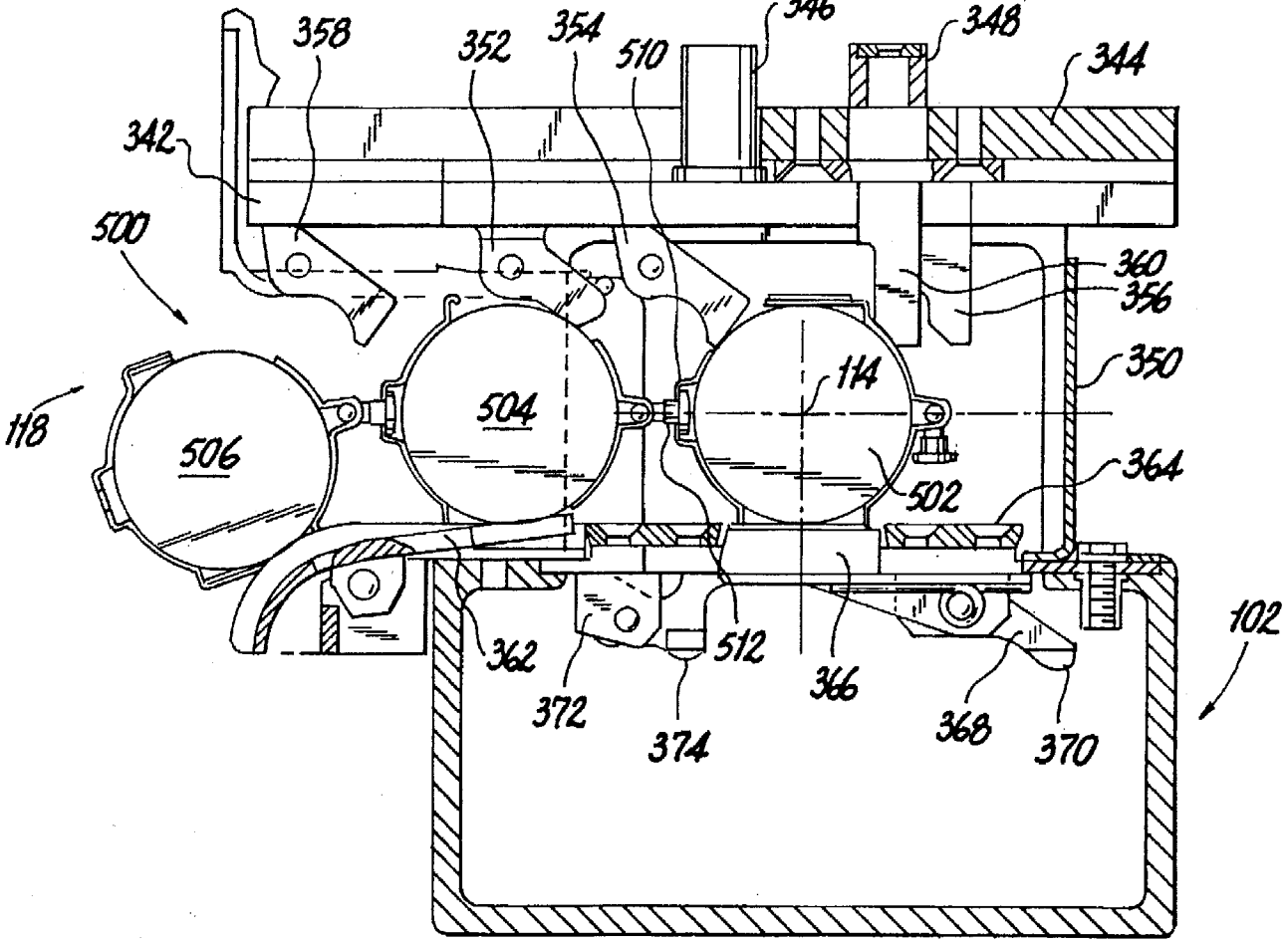
FIG. 6 is a sectional view, such as shown in FIG. 4, in which the frontmost cartridge is in feed position.

If the inertia bolt 202 now commences its forward movement, then the two slides 342, 344 commence such a movement that the two slide pins 346, 348 move towards each other until they reach the position shown in FIG. 5.

The inner pawl 354 has, in the meantime, moved in the direction of introduction of the cartridge belt 500 against the first cartridge 502 and the swing pawl 358 moves away in the direction opposite to the direction of introduction.

Upon the further movement, the inner pawl 354 pushes the first cartridge 502 up to in front of the cartridge chamber 108 (see FIG. 3), while the swing pawl 358 moves towards the outside over the second cartridge 504. The fixed support 360 is moved up to the first cartridge which is held fast in a precisely defined position between said fixed support 360, the inner pawl 354, and cartridge rest fingers 366, which will be explained further below. The fully erected outer pawl 253 lies against the side of the second cartridge 504 which faces the first cartridge 502.

The distance between the two slide pins 346, 348 has reached its minimum.

The bolt head 224 has now reached by the impact bottom 208 the bottom of the cartridge and pushes the first cartridge 502 forward.

In this connection, the pivot pin 512 on the belt member 508 of the second cartridge 504 moves in the slot of the projection 510 on the belt member 508 of the first cartridge. The two slides 342, 344 reverse their direction of movement and begin to move apart with their slide pins 346, 348.

In this relative position of the two slides 342, 344, the second slide 344, as already explained above, grips over the outer pawl 352 and thereby prevents it from swinging.

The outer pawl 352 thus pushes the second cartridge 504 away, opposite the direction of introduction of the first cartridge 502, the pivot pin 512 of the belt member 508 of the second cartridge 504 being pulled out of the widening in the slot of the facing projection 510.

Figure 7:
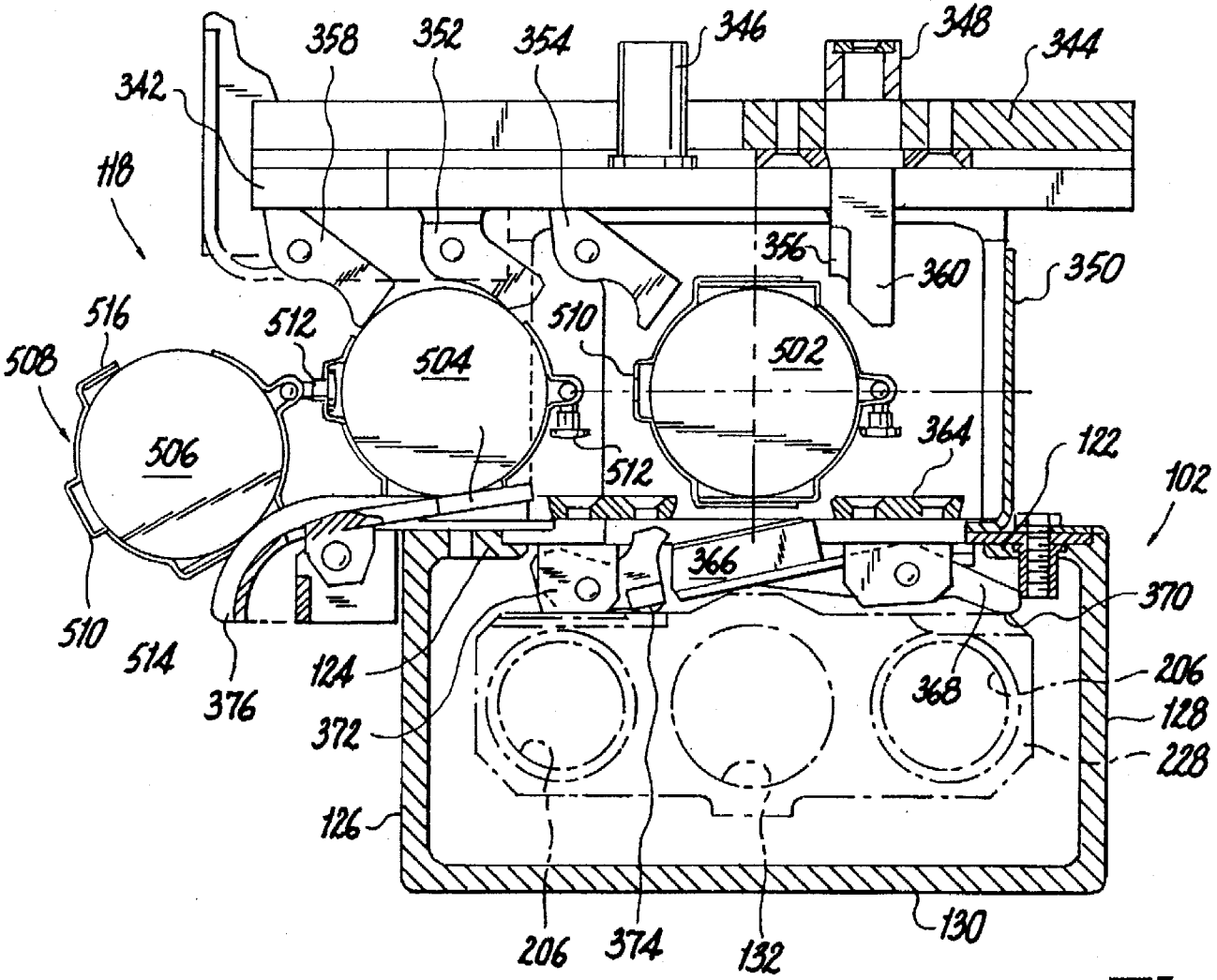
FIG. 7 is a sectional view, such as shown in FIG. 4, upon the start of the return of the inertia bolt.
Figure 8:
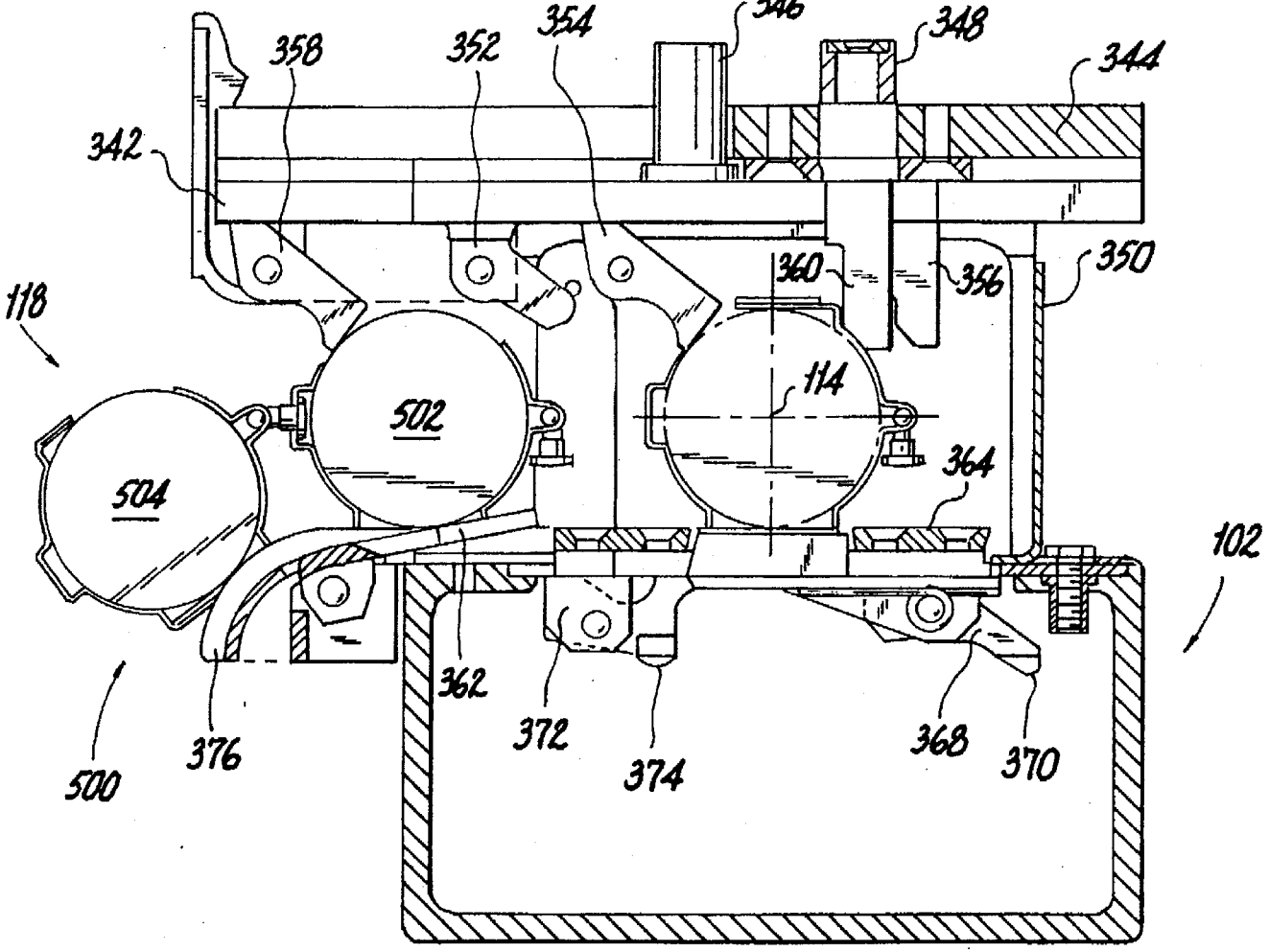
FIG. 8 is a sectional view, such as shown in FIG. 4, upon the extraction of the fired cartridge case.

The second cartridge 504 moves further outward until it comes to rest against the swing pawl 358 (position in FIG. 7). In this connection, the second cartridge has made room for the passing bolt head 224, in the same way as the inner pawl 354 and the fixed support 360, both of which are moved back by the first cartridge 502 in order to permit the bolt head 224 to pass. The lateral supporting of the cartridge 502 is now no longer necessary since the front part of the cartridge is already in the cartridge chamber 108 and the bottom of the cartridge is held on the impact bottom 208.

When the cartridge 502 is fired, then all elements of the feeder device are in the position shown in FIG. 7.

The return travel of the bolt now commences and the sequence of movements described above takes place in the reverse direction.

Upon the extraction of the cartridge case shot, the inner pawl 354 and fixed support 360 approach and guide it.

The two slides 342, 344 with their slide pins 346, 348 then move rapidly apart, the swing pawl 358 bringing the previously second cartridge 504, which is now the first cartridge 502, up into the position shown in FIG. 4 where it is gripped from behind by the blocking lever 362.

In this connection, the fixed stop 356 or 350 prevents the cartridge 502 from being conveyed too far.

On the outside of the housing 102, below the left entrance opening 118, there is an outwardly and downwardly curved belt guidance platform 376. If the right entrance opening 116 is used for the introduction of the belt, then, on basis of its symmetrical construction, it can also be removed, turned around and introduced in the right-hand entrance opening 116.

The blocking lever 362 can also be arranged in front of the right entrance opening 116.

Adjoining the belt guide platform 376 in the housing 102 at the same level, there is a horizontal guide table 364 which, behind the cartridge chamber 108, has an opening which is bridged over by a cartridge resting finger 366 at the same height.

Said finger is swingably mounted on the right below the adjoining edge of the guide table 364 on an axis parallel to the longitudinal center line 114 and is pressed upward by a spring, said opening in the guide table 364 fixing its upper end position.

The cartridge resting finger 366 is extended downward to the right beyond the mounting by a guide lever 368 the end of which forms a guide-lever driver 370.

This guide-lever driver 370 is so arranged, in combination with the movement of the inertia bolt 202, that when the frontmost cartridge 502 is to be introduced into the cartridge chamber, the bolt 228 (shown in dashed line in FIG. 7) comes against the guide-lever driver 370 and in this connection swings the cartridge resting finger 366 downward (FIG. 7) to such an extent that the cartridge 502, despite its protruding edge and despite the lower flattened projection 514 of the belt member 508, can align itself precisely coaxial to the cartridge chamber 108 and thus to the longitudinal center line.

In order to prevent the cartridge resting finger 366 swinging in uncontrolled manner downward under the action of blows, a clamping lever 372 is arranged swingable around an axis parallel to the center line 114 below the left-hand edge of said opening in the guide table 364, the lever engaging below the free end of the cartridge resting finger 366 and thus holding it fast.

The clamping lever 372 is provided on its lower side with a clamping-lever driver 374 which can be pressed upward by the bolt carrier 228, in the same way as the guide-lever driver 370, in order to release the guide lever 368 (FIG. 7).

As can be seen, the cartridge resting finger 366 is swung away only when the cartridge 502 is just introduced into the cartridge chamber 108 or its cartridge case is extracted from it.

All the elements described above which come into direct contact with the cartridge belt 500 are preferably arranged at least in duplicate alongside each other in longitudinal direction of the weapon in order to make certain that the cartridges 502, 504, 506 are always aligned and remain parallel to the longitudinal center line 114 during the entire operation of the feeder.

On both sides of the entrance opening 118 used for the introduction of the belt, there is located, as shown in FIG. 2, a cartridge belt feed roller 378 mounted for rotation around a vertical axis, the diameter of which roller corresponds approximately to that of a cartridge 502, 504, 506. In this way, a cleaner introduction of the belt is assured.

These cartridge belt guide rollers 378 can also be arranged on the other entrance opening 116.

The Trigger Device Group 400

The trigger device group has the actual trigger device 402, which is arranged in a housing-like box which is attached to the rear of the end covering 110 of the housing 102 and is seated between the two handles 146, 148.

On both sides of the box, in ergonomic association with the handles 146, 148, there is a thumb plate 406 which serves as trigger and is connected with the trigger lever 404 in such a manner that upon depression of one or both of the thumb plates 406, the free end of the trigger lever 404 lifts up, thereby releasing the trigger sears 230 and thus permitting the inertia bolt 202 to move rapidly forward.

Below the thumb plate on one or each sidewall of the box, there is a safety and fire-selection lever which is arranged, fixed for rotation, on a shaft 408 (FIG. 10).

The safety and fire-selection lever has, as well as the shaft 408, three positions of rotation, namely S (safety), E (individual fire) and D (continuous fire). The position shown in FIG. 10 is the position S (safety).

The construction of the associated safety and fire-selection device is traditional and is not shown here; in the turned position S, the thumb plates 406 and the trigger lever 404 are locked; in the other positions of rotation they are released; furthermore, in the position of rotation E (individual fire), after a single swinging of the trigger lever 404, the connection between it and the thumb plate 406 is interrupted so that the trigger lever 404 can, after the release of a shot, again assume its trigger-sear holding position, even if the thumb plates 406 remain depressed; in the turned position D (continuous fire), thumb plates 406 and trigger lever 404 are continuously connected for movement together.

In addition to the known safety device described, the shaft 408, however, also has a non-circular control section, shown in FIG. 10, which is surrounded by the forked end of the one arm (support arm) 418 of a safety angle lever 424.

In the safety position S shown, the forked supporting arm 418 is pressed with its rear end edge against a stop 420. In the individual-fire and continuous-fire positions E and D, on the other hand, the support arm 418 is moved away from the stop 420 by the non-circular control section of the shaft 408.

The safety angle lever 424 is mounted for swinging in the region of its vertex and has, as second arm, a catch hook 412 which, in the safety position S, extends forward over the catch projection 232 of the inertia bolt 202 and grips around the latter.

On the safety angle lever, there is furthermore seated a projection 410 which has a flattening which rests flat against a pressure plate 422 in the safety position S shown, the pressure plate, in its turn, being swingably mounted and urged by a spring against the projection 410.

As shown in FIG. 10, the catch projection 232 and the free end of the catch hook 412 have a complementary development so that they can engage firmly behind each other and hook to each other when the inertia bolt 202, despite the selection of the safety position S, starts to move forward, for instance as a result of a break of the trigger lever 404.

In contrast to the turned position S, in positions E and D of the shaft 408 the safety angle lever 424 is so swung that the hook-shaped curved free end of the catch hook 412 is lifted out of the path of movement of the catch projection 232 and does not prevent the free movement of the inertia bolt 202.

To be sure, if the support arm 418 breaks, so that the safety angle lever no longer responds to the turned position of the shaft 408, then the pressure plate 422 brings the projection 410, and thus the catch hook 412, into the safety position S shown.

As a result of the shape of the hook arrangement, upon the engagement thereof the catch hook 412 is held fast and the shaft 408 thus blocked, so that it is not possible to disengage the safety of the weapon and thus unintentionally to fire at the same time.

The above-described trigger device proper releases the inertia bolt 202 but not the actual firing process. The latter is released by the firing device shown schematically in FIG. 9, namely in association with the precise position of the inertia bolt 202; it has been pointed out above that, in the case of the weapon of the invention, the maintaining of a precisely defined firing time within very close tolerances is particularly important.

As already explained when describing housing group 100, a cam 138 for the firing pin case 416 extends along the path of movement of the bolt head 224 on the right housing rib 122 and a cam 140 for the firing pin 414 extends on the left housing rib 124.

The firing pin case 416 has a bar-shaped front part and a piston-shaped rear part which is received, movable back and forth, in the axial hole 212 in the bolt head 224 which hole is provided with a suitable diameter.

The two parts are passed through by a case lengthwise hole 426, having a front, narrow passage for the tip of the firing pin, a main section for the shank of the firing pin, and a widened end section to receive the thickened end of the firing pin.

On the outer circumference of the widened end section, there is a depression which is developed as guide-lever recess 428.

The firing pin 414, as already indicated, has a firing-pin tip, a narrow firing-pin shank provided with guide-ring projections and a thickened firing-pin end having a rearwardly open blind hole which is formed to receive an impact spring (not shown).

On the outer side of the thickened end of the firing pin, a transverse projection with hole through it is formed thereon; the hole of the transverse projection, which hole is conically widened towards its end, forms a cocking-lever receiver 434.

The rear end of the axial hole 212 in the bolt head 224 is closed by a spring-support bushing 444 on the bottom of which the firing spring received in the blind hole in the thickened end of the firing pin rests.

The bolt head 224 is slit from above down to its axial hole 212 at the places at which the regions of movement of the guide-lever receiver 428 and the cocking-lever receiver 434 are located; within the slit arrangement which is thus formed, there lie, one behind the other, three control elements mounted in each case on a corresponding horizontal transverse axis in the bolt head 224.

The frontmost of these control elements is a guide lever 430 which is formed in the manner of a cradle and with its two protruding ends extends along the cam 138 for the firing pin case 416.

As can be seen, the tilted position of the guide lever 430 is dependent on the shape of the cam 138.

The guide lever 430 has a rectangularly protruding driver finger 432 arranged fixed in position, the spherically thickened free end of which is seated in the guide-lever receiver 428.

The tilted position of the guide lever 430 thus positively determines the axial position of the firing pin case 416.

The cam 138 is so developed that the guide lever 430 can assume its front position only in that region of the bolt movement in which also the firing is to take place. Since, however, the passage for the tip of the firing pin 414 which is formed by parts of the axial hole 212 and of the case longitudinal hole 426 can only be sufficiently short to permit the tip of the firing pin to pass through to a length which is sufficient for the firing when the firing-pin case 416 is in its front position, such a firing is possible at all only in the above-described narrow region of the bolt movement in which the firing must take place.

The central control element is a cocking lever 436 which, like the guide lever 430, is developed in the form of a cradle and extends along the cam 140, which forces its tilted position around its support.

In contradistinction to the guide lever 430, there is provided on the front end of the cocking lever 436 terminating on the cam 140 a roller which transmits the forces to be applied upon the cocking of the firing spring.

The rear end of the cocking lever 436 is recessed by a detent depression which faces the axis of rotation of the third control element (which will be described further below).

The cocking lever has a cocking finger 440 protruding approximately at a right angle and arranged fixed in position, with a spherical free end which is seated in the cocking-finger receiver 434.

In view of the high forces to be transmitted upon the cocking of the firing spring, the cocking finger 440 and the cocking-finger receiver 434 are made larger than the driver finger 432 and driver-finger receiver 428.

The third, rearmost control element is a release 442 which is developed as double-armed angle lever the one (rear) arm of which is pressed against the cam 140 or a suitable cam and travels on it; the other (front) are has, on its free end, a detent nose 438 which, when the firing spring is cocked, falls into the detent depression on the rear of the cocking lever 436.

As can be seen, the cam 140 can cause a tilting movement of the release 442 the detent nose of which is then swung out of the detent depression, whereupon the cocking lever is released and the firing spring can strike, provided the local development of the cam 140 permits this.

Figure 9:
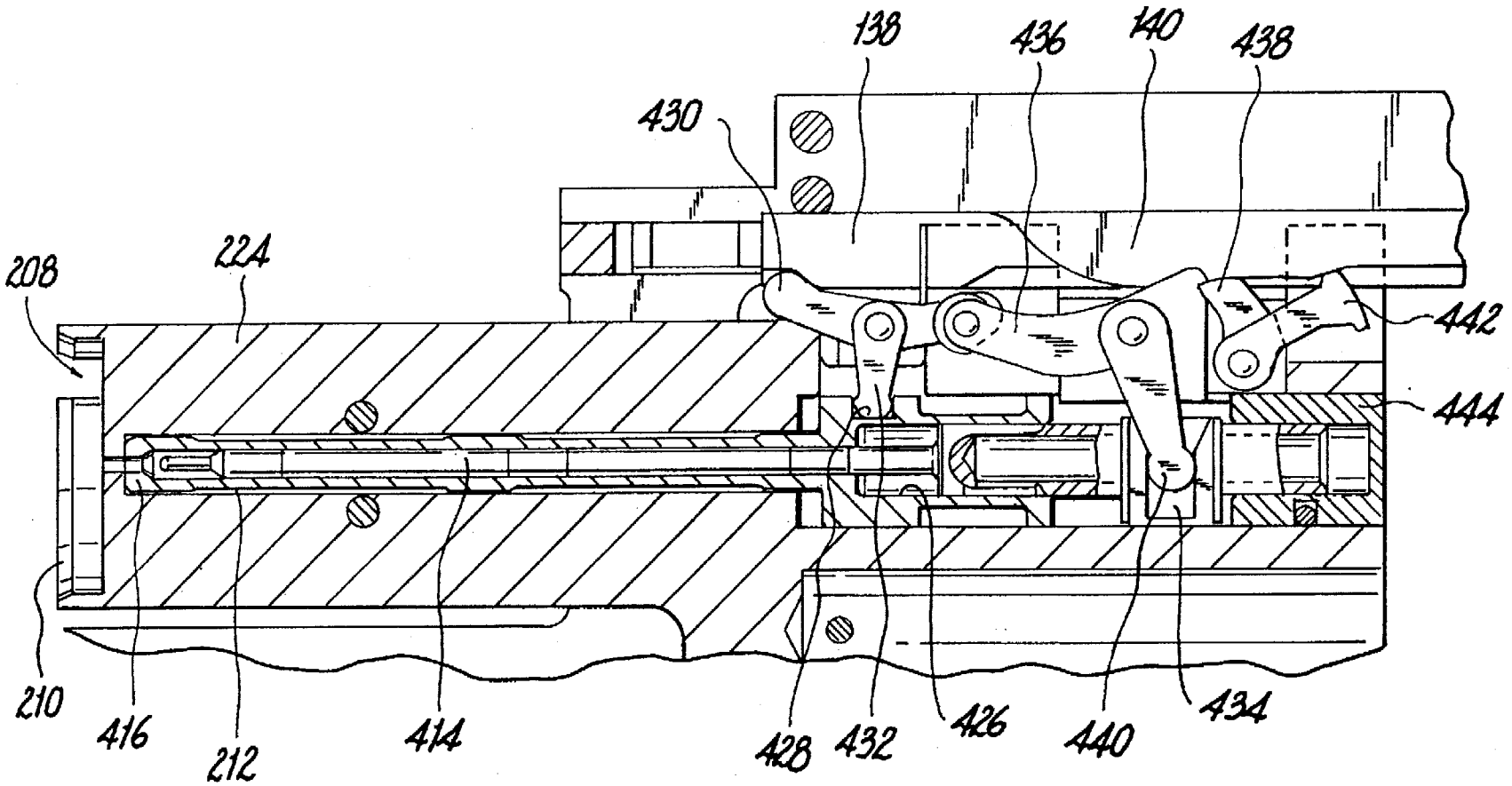
FIG. 9 is a partial section through the bolt head of the inertia bolt.

FIG. 9 shows the position which the firing device assumes very shortly before the firing and therefore at the front end of the cams 138, 140.

The guide lever 430 has already assumed the tilted position in which it has placed the firing pin case 416 in its frontmost position. The cocking lever has already moved away forward over the front bevel of the cam 140, which causes its tilting for the cocking of the firing spring, but does not rest against this cam 140 since it is held in its position by the release 442 via the engagement between the detent projection and the detent nose. When this release, which is directly imminent, is tilted towards the rear by the cam 140, the cocking lever can then tilt, the firing spring can relax, and the firing pin can move rapidly forward and fire the cartridge.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A self-loading grenade launcher comprising:

a cartridge belt feed including a plurality of pawls engaging in said cartridge belt, conveying a cartridge in horizontal direction up to a front of a cartridge chamber, said pawls being supported by at least two slides movable in opposite directions transverse to a firing direction and said pawls are arranged in a swingable feeder cover and protrude downwardly, an inertia bolt, traveling from a release position due to a spring force of at least one closure spring, forward along a path of movement towards a cartridge chamber, said inertia bolt is adapted, upon forward travel, to push the cartridge conveyed by the pawls out of the cartridge belt into the cartridge chamber, and, after firing, due to the resultant recoil, to move back in return travel over the path of movement and cock said at least one closure spring, a control connected to said inertia bolt and said at least two slides and converts said forward and said backward travel of said inertia bolt into transversely directed alternating movement of said slides, a firing device including a firing pin cocked and held in cocked position by a lock, the lock being released and said cartridge fired before the inertia bolt has completed said forward travel, only when the cartridge has been introduced far enough into the cartridge chamber for withstanding the gas pressure of the firing, and a housing connected to said cartridge chamber, extending along the path of movement and surrounding said chamber at least in part, said housing having a longitudinal center line including a center axis of said cartridge chamber; and wherein between said inertia bolt and said housing, there is arranged a barrier comprising at least one ratchet pawl and ratchet teeth permitting said forward travel of said inertia bolt only after said inertia bolt has been moved backward to a minimum cocking position on a preceding return travel.

2. The grenade launcher according to claim 1, wherein said minimum cocking position is present substantially at the release position.

3. The grenade launcher according to claim 1, wherein said barrier is developed as a ratchet barrier with a series of obliquely toothed ratchet teeth disposed along the inertia bolt, and at least one ratchet pawl adapted for engagement with ratchet teeth and, upon forward travel of said inertia bolt, entering into a blocking engagement with said ratchet teeth, which are, upon travel past it, disconnectable by a nose which is disposed at a place corresponding to a minimum cocking position.

4. The grenade launcher according to claim 3, wherein said ratchet pawl is movable by a spring into a position in which said ratchet pawl extends transverse to the path of movement of said inertia bolt, and said ratchet teeth are disposed in a rack-like arrangement extending on said inertia bolt, said arrangement having a start and an end, upon backward or forward travel, moving beyond the ratchet pawl causing an erecting of said ratchet pawl.

5. The grenade launcher according to claim 1, wherein said control connected to said inertia bolt and said slides further comprises:

a cam lever pivotally supported on said housing and extending along said path of movement, and including a cam, a driver, complimentarily disposed on said inertia bolt, so that said cam lever upon forward and return travel of said inertia bolt carries out swinging movements directed transversely; and a rod connecting said cam lever to slides, and converting the swinging movements into an alternating movements of said slides.

6. The grenade launcher according to claim 5, further comprising pivoted mounting of a cam lever arranged approximately centrally over an inertia bolt, and effected on the front end thereof and over the longitudinal center of the housing and in the region of a rear edge of the feeder cover, and wherein said cam lever is coupled about on a front side of a rear third of its length with a rear end of a rear arm of a double-armed shift lever arranged swingably on the housing laterally alongside the cam lever, and wherein said shift lever has at an end of a front arm a detachable pivoted connecting element, which lies free when said feeder cover is open and, with said feeder cover closed, engages in a releasable pivot-connection mating element on a lever control for controlling said two slides.

7. The grenade launcher according to claim 6, wherein said lever control has a first control lever and a second control lever, movable in opposite directions symmetrically to the longitudinal center line of the housing.

8. The grenade launcher according to claim 7, wherein said first and said second control levers are disposed at the same distance away on both sides of said longitudinal center line of the housing in said feeder cover close to its rear edge, and extending by approximately an equal distance forward and away from said longitudinal center line of the housing and having their front end form a pivotal connection with a first and a second slide, and one of said control levers being linearly lengthened around its support place and ending in a pivotally connected mating element.

9. The grenade launcher according to claim 8, wherein each of said control levers includes an arm, said arms protruding towards each other preferably at about a right angle from their place of support and said two arms are pivotally connected to each other.

10. A grenade launcher according to claim 9, wherein the two arms each have a free end and said pivotal connection is disposed on one of the free ends, and on the other free end a slide curve including a driver developed as an engagement pin, is disposed on said free end of said other arm and said driver is engaged to form a substantially play-free forced control.

11. A grenade launcher according claim 10, wherein said pivotal connection between one of said first and second slide and the first and the second control lever are developed such as to include a fixed pin protruding towards one of a control lever and a roller disposed on the slide which engages in a slot on an end of the control lever.

12. The grenade launcher according to claim 11, wherein each of said two slides are guided movably back and forth in a transverse guide, wherein the two transverse guides are so developed in agreement with each other such that said two slides are exchangeable.

13. A grenade launcher according to claim 12, wherein in said release position of said inertia bolt, both slides assume an outermost end position in which they are furthest outside from the longitudinal center line of the housing, in which connection the first slide, which is located on a side of an entering cartridge belt, and has between its outer side and the longitudinal center line of the housing, an inner pawl which is mounted pivotally and under spring action and is developed such as to engage behind a first cartridge of said cartridge belt in the direction of conveyance of said belt and displaces said belt in an opposite direction and swings over a following cartridge, and said second slide facing away from said entrance of the cartridge belt bearing on its outer side a fixed support and on its opposite side a swing pawl which is pivotally mounted under spring action, during the inertia-bolt forward travel, said two slides move in opposite directions transverse to said longitudinal center line of the housing, the inner pawl guides the first cartridge up to in front of said cartridge chamber and said support on the side opposite the inner pawl forms a stop for the cartridge, said inertia bolt in said final portion of its forward travel pushes the cartridge in front of the cartridge chamber together with the belt member surrounding it out of the belt connection and pushes said cartridge into said cartridge chamber, upon opening of the inertia bolt, said inner pawl moves away over said following cartridge, said swing pawl approaches said cartridge from said outer side, and said support moves away towards said outer side from an extracted cartridge case in order not to prevent extraction thereof, and, during the remaining rearward travel of the inertia bolt, the swing pawl conducts the following cartridge up into the position which it assumes as the first cartridge in the release position of the inertia bolt.

14. A grenade launcher according to claim 13, wherein said first slide has on its inner side a first stop which prevents undesired further sliding of the last cartridge of a cartridge belt.

15. The grenade launcher according to claim 13, wherein on said outer side of said first slide there is arranged an outer pawl mounted pivotally under spring action, said outer pawl, during the last section of forward travel of the inertia bolt, being locked in its active position so that upon movement opposite to the direction of conveyance of the cartridge belt it does not swing away over the following cartridge, and said first slide carrying out with said locked outer pawl, one of a rearward and outward movement in which a following cartridge is moved away in direction opposite the direction of conveyance by the engagement with an outer flank of said outer pawl of said first cartridge which has been already removed from the belt, until said following cartridge strikes against said inner surface of said swing pawl.

16. The grenade launcher according to claim 15, wherein said second slide, upon the last section of the forward travel of the inertia bolt, grips over the outer pawl thereby locking it.

17. The grenade launcher according to claim 16, further comprising a buffer spring arrangement for delaying the final phase of the forward travel for avoiding damage to said grenade launcher upon empty firing thereof.

18. The grenade launcher according to claim 17, further comprising two spring guide rods arranged in the housing, each of which passes through a longitudinal hole in the inertia bolt and on each of which one of the closing springs is seated, wherein, for forming said buffer spring arrangement, there is arranged at the front end of each spring guide rod a buffer spring which rests against the housing and sits over the greatest part of its length in a receiving hole being passed through by a corresponding spring guide rod.

19. The grenade launcher according to claim 18, wherein said inertia bolt is passed through by at least one longitudinal channel which is displaceably guided with a clearance fit on a longitudinal guide which is fixedly arranged in position in said housing.

20. The grenade launcher according to claim 19, wherein said longitudinal channel is developed as fitted hole and said longitudinal guide as a preferably tubular fitted round rod.

21. The grenade launcher according to claim 20, wherein said housing is formed of a box-profile section on an extruded-profile section, a front side of which is closed by a block which receives the cartridge chamber.

22. The grenade launcher according to claim 21, wherein said box-profile section comprises a lower part which is formed from a closed hollow-profile strand on which a hollow-profile strand open on top connected as one piece with it is seated, the closed hollow-profile strand receives the inertia bolt, and the open hollow-profile strand receives the control and being closed from above by a removable housing cover.

23. The grenade launcher according to claim 22, wherein at least a part of the outer and/or inner surface of the box-profile section is provided with a surface treatment or coating, preferably hard-anodized.

24. The grenade launcher according to claim 23, having a belt conveyance arranged on the entrance opening of the cartridge belt, wherein said belt conveyance has a belt-conveyance platform detachably fastened to said housing and which supports said cartridge belt from below.

25. The grenade launcher according to claim 24, wherein said belt conveyance has a covering being arranged spaced above said belt-conveyance platform and covering and guiding said cartridge belt from above.

26. The grenade launcher according to claim 25, wherein said belt conveyance has, on both sides of the belt-conveyance platform, a cartridge belt guide roller which is rotatable around a vertical axis.

27. A grenade launcher according to claim 26, wherein on both sides of the housing there is an entrance opening for the cartridge belt, and the parts of the belt conveyance are arranged in one of individually, groupwise, and in their entirety at one of the two entrance openings.

28. The grenade launcher according to claim 27, wherein the entrance opening not associated with the belt conveyance is closed by a removable wall, developed as a sheet-metal plate.

29. The grenade launcher according to claim 28, wherein on both sides of said housing there is a mount for the detachable fastening of an ammunition box laterally alongside a corresponding entrance opening.

30. The grenade launcher according to claim 29, wherein the covering is arranged on the ammunition box.

31. The grenade launcher according to claim 30, wherein the ammunition box has a top cover which is swingable around a hinge which is arranged on the sidewall of the ammunition box facing away from the grenade launcher and that the covering is fastened on the cover or developed integral with it.

32. The grenade launcher according to claim 31, further comprising a feeder cover which can be opened for the insertion of the cartridge belt, in which connection, with the feeder cover open, the inertia bolt is in its release position, characterized by the fact that a barrier is provided which, when the feeder cover is open, prevents the striking of the inertia bolt or intercepts the striking inertia bolt before it comes into the region of the cartridge belt feed device.

33. The grenade launcher according to claim 32, wherein the barrier has a feeler which, with the feeder cover closed, assumes a position of rest and, upon the opening of the feeder cover, moves into a barrier position, and that the feeler is connected with a lock which, upon the movement of the feeler into the release position, moves into the path of movement of the inertia bolt.

34. The grenade launcher according to claim 33, wherein the feeler is developed as feeler finger which is urged by a spring into its blocking position and is connected for transmission of movement with a locking lever.

35. The grenade launcher according to claim 34, wherein the inertia bolt bears a cam lever driver which engages in a cam lever which is mounted swingably on the housing, and wherein the locking lever is movable into the path of movement of the cam lever driver.

36. The grenade launcher according to claim 35, wherein the cam lever has a recess which supports the locking lever in a locking position.

37. The grenade launcher according to claim 36, wherein the firing pin is seated in a firing-pin case arranged in the inertia bolt, which case is movable in the direction of the longitudinal center between a front position in which it permits the unimpeded forward movement of the firing pin for the firing of a cartridge and a rear position, in which it prevents the firing pin from carrying out this forward movement.

38. The grenade launcher according to claim 37, wherein said firing-pin case has a rearward open blind hole receiving said firing pin and a bottom of which has a hole for the passage of the tip of the firing pin.

39. The grenade launcher according to claim 37, wherein the firing pin case is connected via a guide lever with a cam which is fastened to the housing and which moves the firing-pin case into the front position upon the forward movement of the inertia bolt only shortly in front of the position thereof in which the firing of the cartridge takes place.

40. A grenade launcher according to claim 39, wherein the firing device has a part arranged between the firing pin and the firing spring which is acted on by the latter, which part, in the absence of loading by the firing spring, controls the cam by covering the guide lever so that the movement of the firing-pin case is absent in the front position.

41. A grenade launcher according to claim 40, having an actuating device which has a handle for drawing the inertia bolt back into its release position which is connected with it for the transmission of pulling force, wherein the handle at the rear end of the housing can be pulled away therefrom in a direction parallel to the longitudinal center line and, with the inertia bolt in the release position, is movable again towards the end of the housing.

42. A grenade launcher according to claim 41, wherein the handle has a releasable barrier by means of which it can be fixed in its position tight at the end of the housing.

43. A grenade launcher according to claim 41, wherein said each closure spring is developed as a coil-compression spring extending parallel to the longitudinal center and being passed through by a spring guide rod, a rear end of said each closure spring rests on the rear end of the housing and the front end of the or each closure spring rests on the inertia bolt, said each spring guide rod extending beyond the inertia bolt rearward to the rear end of the housing and passing through the latter, at said rear end of said each spring guide rod extending in its position of rest up to the front end of the housing a driver arrangement being developed for engagement into the inertia bolt, and said handle being arranged on the rear end of the or each spring guide rod.

44. The grenade launcher according to claim 41, wherein the handle has a lengthwise operating grip extending transverse to its direction of movement, and within the operating grip, there is arranged a release lever which can be spread apart from it by a spring and can be depressed by the hand of the operator in order to release the barrier.

45. The grenade launcher according to claim 44, further comprising a trigger device which has a trigger formed as thumb plate which can be fastened preferably by a safety device, which trigger is connected with a release-lever arrangement which engages in releasable holding manner in a sear arrangement of the inertia bolt present in its release position, characterized by the fact that an additional safety device being provided which holds the inertia bolt directly in its release position or, in case of unintended loosening of the engagement of the release lever arrangement, prevents it from striking.

46. The grenade launcher according to claim 45, wherein the additional safety device has a catch-hook arrangement which grips behind a projection on the inertia bolt.

47. The grenade launcher according to claim 46, wherein said catch-hook arrangement of the safety device is associated shaft and upon the activating of deactivating thereof can be brought into and out of catch position in which it engages behind the projection on the inertia bolt.

48. The grenade launcher according to claim 47, wherein said catch-hook arrangement is fixed in its catch position by the projection on the inertia bolt so that the safety device can only be deactivated when the inertia bolt has been pulled back out of the catch position.

49. The grenade launcher according to 13, wherein, at least one of said pawls, said support, and/or said stop is formed of at least and preferably two substantially identical structural or functional parts lying one behind the other parallel to the longitudinal center line of the housing.

50. The grenade launcher according to claim 49, wherein below a cartridge belt being fed, on said side thereof facing away from said feeder cover, there is arranged a blocking lever which is swingable under spring action against the cartridge belt, said lever moving away downward from the cartridge belt upon its movement in the direction of conveyance and upon its return movement being adapted for supporting engagement into a cartridge, and upon said inertia bolt being in release position, said inertia bolt rests against said frontmost cartridge from the outside and thus forms an application for insertion of said cartridge belt.

51. The grenade launcher according to claim 13, further comprising a guide table extending parallel to said feeder cover and along said cartridge belt conveyor path is arranged below said cartridge chamber, a cartridge rest disposed behind said cartridge chamber being developed on the central section of said guide table, and said cartridge rest being adapted, at least upon the portion of the forward travel of the inertia bolt which is necessary for introducing a cartridge into the cartridge chamber, to move away downwards so that said front side of said inertia bolt together with radially protruding developments on the cartridge can travel unimpeded over said guide table.

52. The grenade launcher according to claim 51, wherein said cartridge rest is developed swingably on one of its side edges around an axis parallel to said longitudinal center line and being extended by a guide lever which extends beyond it and is preferably bent downward, the free end of which lever bears a driver which can be brought into engagement with a mating development on said inertia bolt in order to control the downward swinging of said cartridge rest.

53. The grenade launcher according to claim 52, wherein, below said side edge of said cartridge rest facing away from the axis, there is arranged a swingable clamping lever which locks said position, it bearing a driver which can be brought into engagement with a mating development on the inertia bolt in order to release the lock.

54. A grenade launcher according to claim 53, wherein the cartridge rest includes a cartridge-rest finger which extends transverse to a vertical plane intersecting the longitudinal center line of the housing.

55. The grenade launcher according to claim 54, wherein at least one cartridge-rest finger is disposed in the direction of the longitudinal center line of the housing.

* * * * *